US009379466B2

(12) United States Patent
Hashiguchi

(10) Patent No.: US 9,379,466 B2
(45) Date of Patent: Jun. 28, 2016

(54) CONNECTOR

(71) Applicant: JAPAN AVIATION ELECTRONICS INDUSTRY, LIMITED, Shibuyaku, Tokyo (JP)

(72) Inventor: Osamu Hashiguchi, Tokyo (JP)

(73) Assignee: JAPAN AVIATON ELECTRONICS INDUSTRY, LIMITED, Tokyo (JP)

( * ) Notice: Subject to any disclaimer, the term of this patent is extended or adjusted under 35 U.S.C. 154(b) by 2 days.

(21) Appl. No.: 14/487,968

(22) Filed: Sep. 16, 2014

(65) Prior Publication Data

US 2015/0111400 A1 Apr. 23, 2015

(30) Foreign Application Priority Data

Oct. 18, 2013 (JP) ..... 2013-217501

(51) Int. Cl.

| | |
|---|---|
| ***H01R 12/00*** | (2006.01) |
| ***H01R 12/71*** | (2011.01) |
| ***H01R 13/24*** | (2006.01) |
| *H01R 12/57* | (2011.01) |

(52) U.S. Cl.

CPC ..... *H01R 12/714* (2013.01); *H01R 13/2428* (2013.01); *H01R 12/57* (2013.01)

(58) Field of Classification Search

CPC ..... H01R 9/096; H01R 12/57; H01R 12/714; H01R 13/2428; H01R 23/722; H05K 7/1069

USPC ..... 439/66, 65, 91, 862

See application file for complete search history.

(56) References Cited

U.S. PATENT DOCUMENTS

| | | | | |
|---|---|---|---|---|
| 4,533,203 | A * | 8/1985 | Feldman et al. | 439/64 |
| 5,807,123 | A * | 9/1998 | Spiegelaar et al. | 439/188 |
| 5,980,335 | A * | 11/1999 | Barbieri | H01R 13/03 439/824 |
| 6,626,708 | B2 * | 9/2003 | Phillips | 439/700 |
| 7,150,632 | B2 * | 12/2006 | Lee et al. | 439/66 |
| 7,226,293 | B2 * | 6/2007 | Na et al. | 439/66 |
| 7,989,045 | B2 * | 8/2011 | Chang | 428/98 |
| 8,052,428 | B2 * | 11/2011 | Tsao | 439/66 |
| 2010/0041270 | A1 * | 2/2010 | Chen | 439/578 |
| 2010/0087072 | A1 * | 4/2010 | Neidich et al. | 439/66 |

FOREIGN PATENT DOCUMENTS

JP 2003168510 A 6/2003

* cited by examiner

*Primary Examiner* — Neil Abrams
*Assistant Examiner* — Travis Chambers
(74) *Attorney, Agent, or Firm* — Holtz, Holtz & Volek PC

(57) ABSTRACT

A connector including a soft spring portion. A connector that electrically connects a first printed circuit board and a second printed circuit board includes a contact portion that can be brought into contact with the first printed circuit board, a connection portion that can be connected to the second printed circuit board, and an elastic spring portion that connects the contact portion and the connection portion. The elastic spring portion includes a first spring portion and a second spring portion that are connected via an open loop-shaped integral connection portion.

13 Claims, 21 Drawing Sheets

CONNECTOR

BACKGROUND OF THE INVENTION

1. Field of the Invention

This invention relates to a connector.

2. Description of the Related Art

Conventionally, there has been proposed a conductive member that achieves conduction between an earth pattern on a printed wiring board and a grounding conductor (see Japanese Laid-Open Patent Publication (Kokai) No. 2003-168510, Paragraphs 0001, 0015 to 0018, 0020, and 0021, FIGS. 2 and 4, and so forth). This conductive member will be described with reference FIGS. 19 to 21.

The conductive member, denoted by reference numeral 901, is formed by bending a thin metal plate, and comprises two joint portions 910, two side portions 920, and one contact portion 930.

Upper portions of the two substantially rectangular side portions 920 are integrally connected by two integral connection portions 950. The two joint portions 910 are formed by bending lower parts of the two side portions 920 inward substantially perpendicularly, respectively. Lower surfaces of the joint portions 910 form joint surfaces 910A which are soldered to a circuit pattern CP of a printed wiring board PWB.

A tongue piece 921 is formed such that it is bent inward substantially perpendicularly from a bordering end of one of the side portions 920. The contact portion 930 is formed such that it extends from a lower end 921A of the tongue piece 921. The contact portion 930 includes an arm portion 931 which is bent from the lower end 921A of the tongue piece 921 and extends obliquely upward, and a protruding portion 932 which is formed by being bent back from the arm portion 931 toward the opposite side of the joint portion 910. The protruding portion 932 is a portion which is brought into contact with a grounding conductor GC. The protruding portion 932 is substantially arc-shaped, and protrudes above the side portion 920. The integral connection portions 950 restrict end portions 932B of the protruding portion 932 from being displaced in a direction away from the joint portions 910.

The joint surfaces 910A of the joint portions 910 are soldered to the circuit pattern CP of the printed wiring board PWB, whereby the conductive member 901 is mounted on the printed wiring board PWB.

The printed wiring board PWB on which the conductive member 901 has been mounted is fixed to a predetermined location of the grounding conductor GC, such as a casing, whereby the protruding portion 932 of the contact portion 930 is brought into contact with the grounding conductor GC. At this time, the arm portion 931 and the like are elastically deformed, and the protruding portion 932 is moved in a direction toward the joint portions 910, and hence the protruding portion 932 is pressed against the surface of the grounding conductor GC by the returning force of the arm portion 931. As a consequence, the circuit pattern CP of the printed wiring board PWB is positively electrically connected to the grounding conductive GC.

As described above, the arm portion 931 which presses the protruding portion 932 against the grounding conductor GC has a simple shape which is bent from the lower end 921A of the tongue piece 921, and extends straight obliquely upward, and the length of the arm portion 931 which functions as a spring is short.

Therefore, when the circuit pattern CP of the printed wiring board PWB is electrically connected to the grounding conductor GC using the conductor member 901, the arm portion 931 is hard and is not smoothly moved.

SUMMARY OF THE INVENTION

The present invention has been made in view of these circumstances, and an object thereof is to provide a connector having a soft spring portion.

To attain the above object, the present invention provides a connector that electrically connects a first object to be connected and a second object to be connected, including a contact portion that can be brought into contact with the first object to be connected, a connection portion that can be connected to the second object to be connected, and an elastic spring portion that integrally connects the contact portion and the connection portion, characterized in that the elastic spring portion includes an integral connection portion that is open loop-shaped, and a first spring portion and a second spring portion that are integrally connected via the integral connection portion, and when the contact portion is pressed by the first object to be connected, causing elastic deformation of the elastic spring portion, the integral connection portion can be moved in the same direction as a contact portion-moving direction in which the contact portion is moved.

Preferably, the first spring portion and the second spring portion are arranged on an imaginary straight line which extends through the contact portion and is parallel to the contact portion-moving direction, and the integral connection portion is shifted from the imaginary straight line in an orthogonal direction orthogonal to the contact portion-moving direction.

More preferably, the connector further comprises a cover portion that is provided integrally with at least one of the first spring portion, the second spring portion, and the connection portion, and covers the first spring portion, the second spring portion, and the integral connection portion.

Further preferably, the cover portion has a hollow rectangular prism shape.

Further preferably, the cover portion has a hollow cylindrical shape.

Further preferably, the cover portion includes a cover portion-side contact portion that is brought into contact with the contact portion.

Even more preferably, the cover portion includes two said cover portion-side contact portions.

Further preferably, the cover portion includes a stopper that receives, when the contact portion is pressed by the first object to be connected, causing elastic deformation of the elastic spring portion, the second spring portion so as to prevent the second spring portion from protruding out of the cover portion.

Further preferably, the cover portion includes a flat surface that can be surface-mounted on the second object to be connected.

Further preferably, the cover portion includes a protruding portion extending along the imaginary straight line.

Preferably the first spring portion includes a first supporting arm portion that supports the contact portion, and extends in an intersecting direction intersecting with the contact portion-moving direction, a first bent portion that is arc-shaped and is integrally connected to the first supporting arm portion, a first intermediate arm portion that is integrally connected to the first bent portion and extends in a direction opposite to the first supporting arm portion.

More preferably, the second spring portion includes a second supporting arm portion that supports the connection portion and extends in the intersecting direction, a second bent portion that is arc-shaped and is integrally connected to one end of the second supporting arm portion, and a second intermediate arm portion that is integrally connected to the second bent portion and extends in a direction opposite to the second supporting arm portion, the integral connection portion includes a third bent portion that is arc-shaped and is integrally connected to the first intermediate arm portion, an integral portion-side arm portion that is integrally connected to the third bent portion and extends in the contact portion-moving direction, a fourth bent portion that is arc-shaped and is integrally connected to the integral portion-side arm portion, a fifth bent portion that is arc-shaped and is integrally connected to the second intermediate arm portion, and a linear arm portion that connects the fourth bent portion and the fifth bent portion, and the cover portion is integrally connected to the other end of the second supporting arm portion.

Preferably, the contact portion has a shape bent into a U-shape, and a protruding end of the contact portion is a bottom of the U-shape.

Preferably, the connector can be electrically connected to the second objet to be connected, by having the connection portion brought into contact therewith.

Preferably, the connector can be electrically connected to the second objet to be connected, by having the connection portion soldered thereto.

According to the present invention, it is possible to provide a connector having a soft spring portion.

The above and other objects, features and advantages of the present invention will become more apparent from the following detailed description taken in conjunction with the accompanying drawings.

DETAILED DESCRIPTION OF THE PREFERRED EMBODIMENTS

The present invention will now be described in detail with reference to the drawings showing preferred embodiments thereof.

Figure 1:
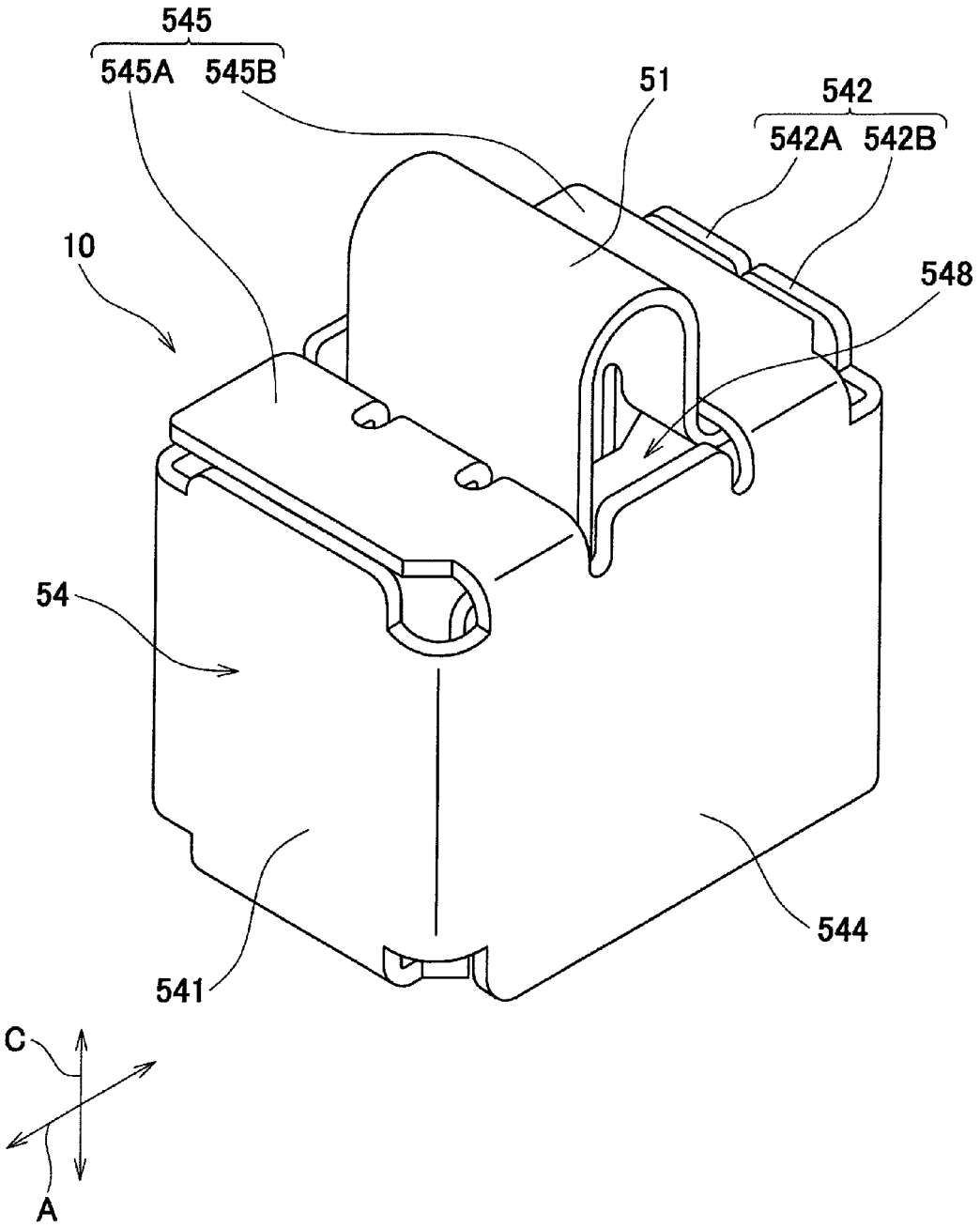
FIG. 1 is a perspective view a connector according to a first embodiment of the present invention.
Figure 2:
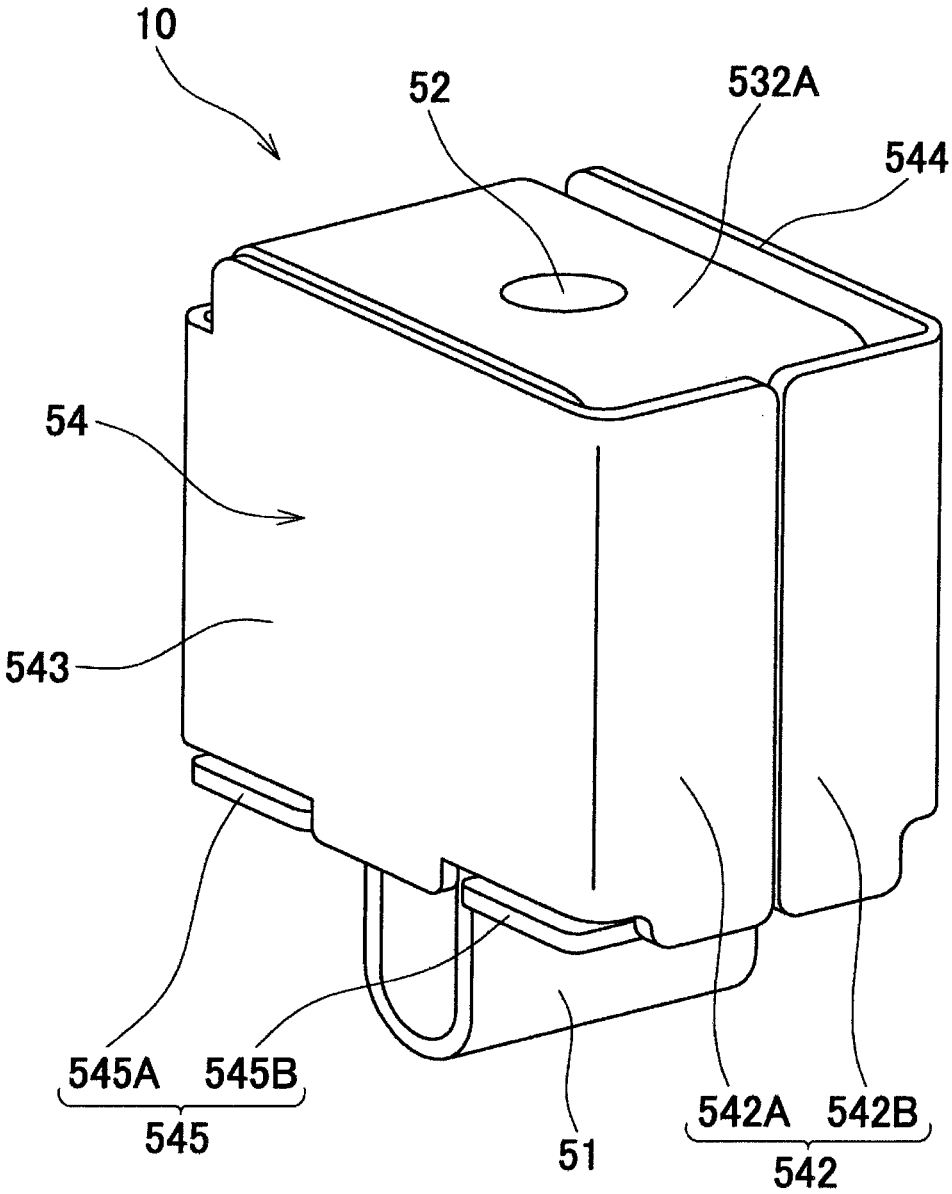
FIG. 2 is a perspective view of the connector shown in FIG. 1, as viewed obliquely from below.
Figure 3:
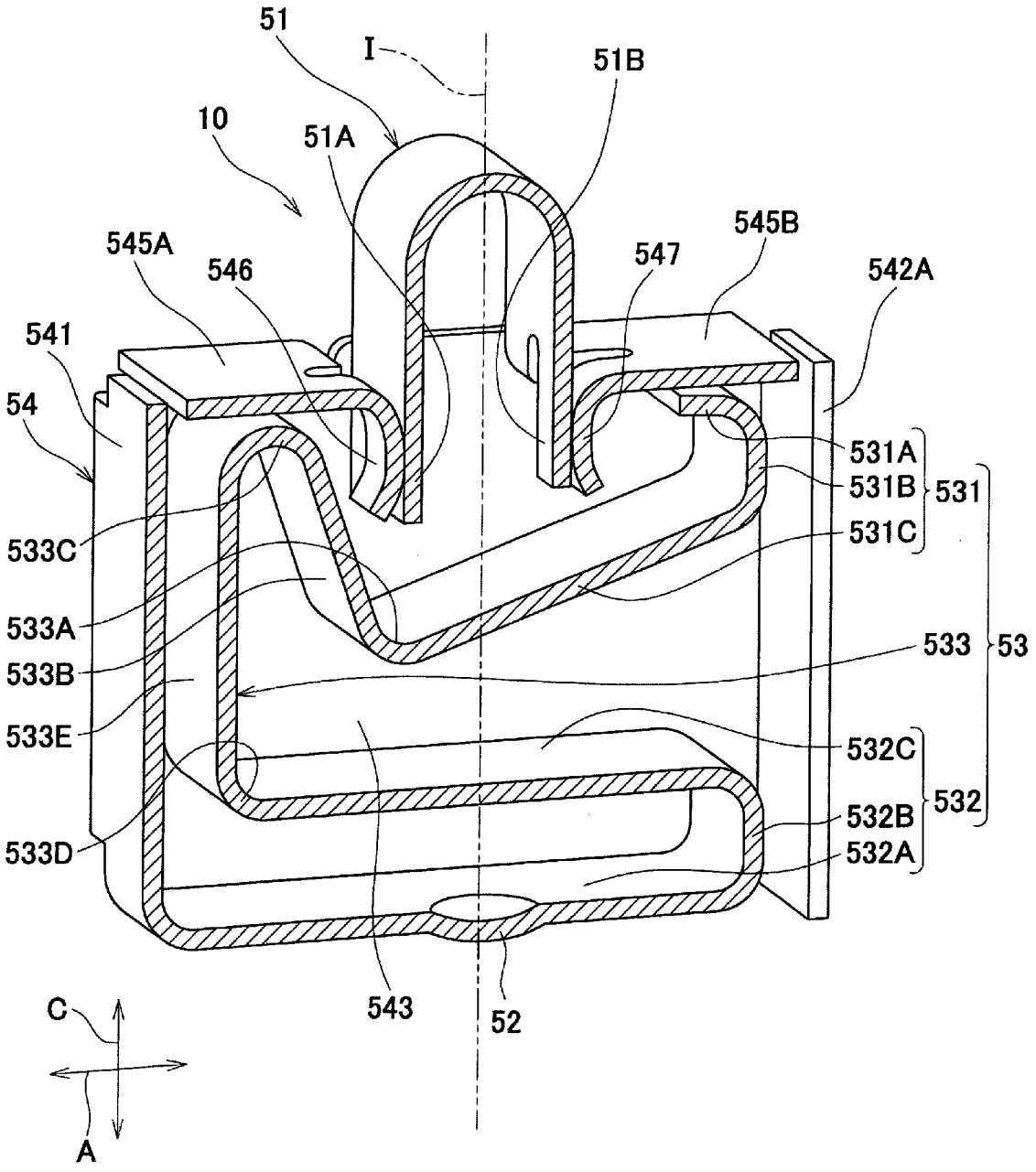
FIG. 3 is a perspective view, partly in cross-section, of the connector shown in FIG. 1.

As shown in FIGS. 1 to 3, a connector 10 according to a first embodiment of the present invention comprises a contact portion 51, a connection portion 52, an elastic spring portion 53, and a cover portion 54. When the connector 10 is sandwiched between a first printed circuit board (first object to be connected), not shown, and a second printed circuit board (second object to be connected), not shown, the connector 10 electrically connects the first printed circuit board and the second printed circuit board. The connector 10 is formed e.g. by blanking and bending a metal plate (not shown) using a press apparatus. Note that a direction in which the contact portion 51 of the connector 10 is pressed by the first printed circuit board, whereby the first printed circuit board and the contact portion 51 are brought into contact with each other, is defined as a contact portion-moving direction (hereinafter referred to as the contact direction) C.

The contact portion 51 is formed by bending part of the metal plate into a U-shape, and a bottom portion of the U-shape is used as a contact point portion via which the connector 10 contacts the first printed circuit board. When the connector 10 is sandwiched between the first printed circuit board and the second printed circuit board, the contact portion 51 is brought into contact with a pad of the first printed circuit board.

When the elastic spring portion 53 is not elastically deformed, one end 51A of the contact portion 51 in an orthogonal direction A which is orthogonal to the contact direction C is in contact with a first cover portion-side contact portion 546, and the other end (sub contact portion) 51B of the contact portion 51 in the orthogonal direction A is in contact with a second cover portion-side contact portion 547. When the elastic spring portion 53 is elastically deformed (see FIG. 5), a portion of the contact portion 51 continuous with the one end 51A is in contact with the first cover portion-side contact portion 546, and a portion of the contact portion 51 continuous with the other end 51B is in contact with the second cover portion-side contact portion 547. As described above, the contact portion 51 is always in contact with the first cover portion-side contact portion 546 and the second cover portion-side contact portion 547.

The connection portion 52 has a convex spherical surface shape protruding toward the second printed circuit board, and is located below the contact portion 51. When the connector 10 is sandwiched between the first printed circuit board and the second printed circuit board, the connection portion 52 is brought into contact with a pad of the second printed circuit board.

Figure 5:
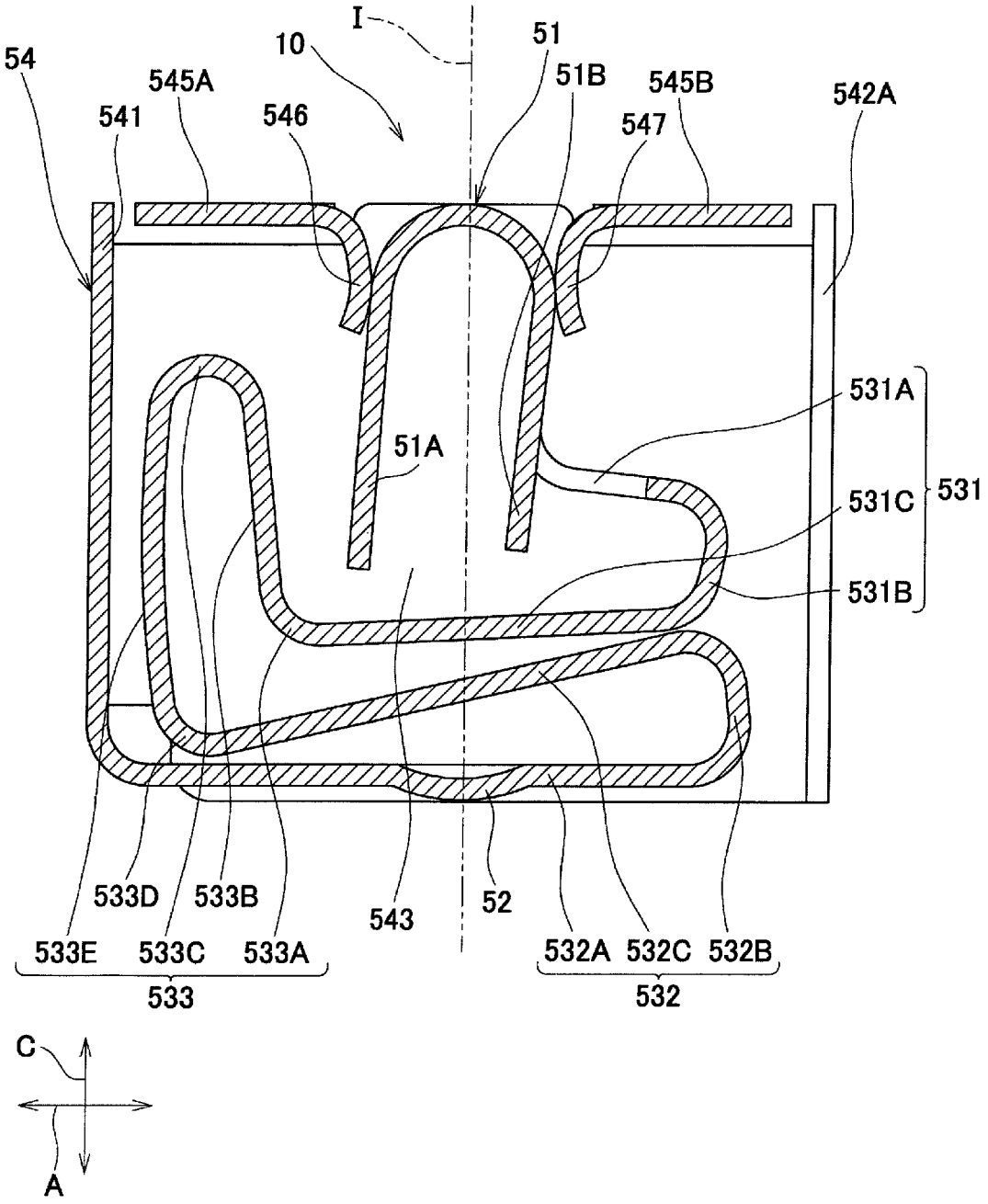
FIG. 5 is a cross-sectional view of the connector shown in FIG. 1 in a state in which a contact portion is retracted into the cover portion.

The elastic spring portion 53 is elastically deformed and compressed when the connector 10 is sandwiched between the first printed circuit board and the second printed circuit board, as shown in FIG. 5.

Figure 4:
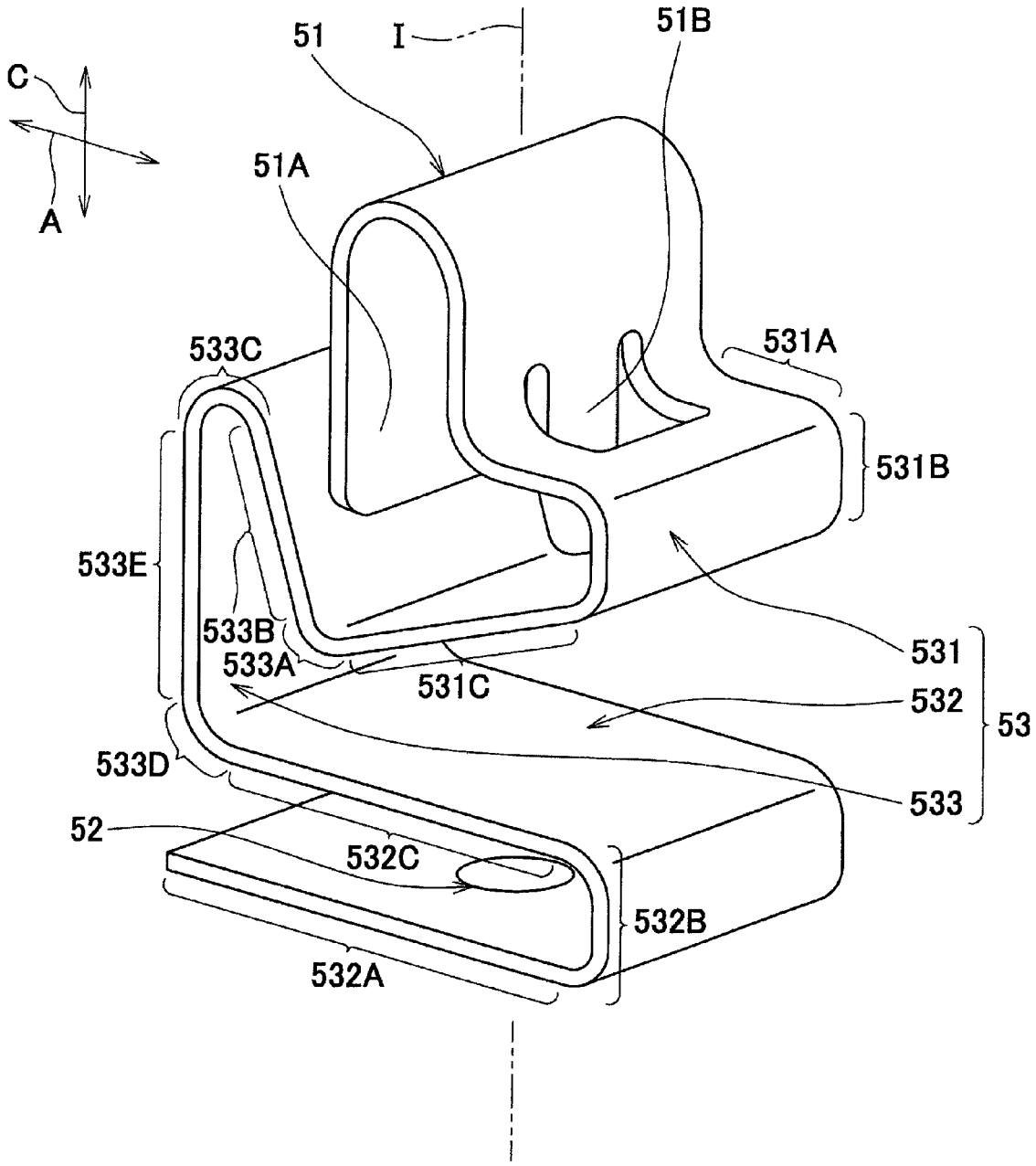
FIG. 4 is a perspective view of part of the connector shown in FIG. 1 from which a cover portion is removed.

As shown in FIGS. 3 to 5, the elastic spring portion 53 is formed by a first spring portion 531 having a substantially J-shape, a second spring portion 532 having a substantially U-shape, and an integral connection portion 533 having a substantially C-shape.

The first spring portion 531 includes a first supporting arm portion 531A, a first bent portion 531B, and a first intermediate arm portion 531C. The first supporting arm portion 531A has one end integrally connected to the contact portion 51, and extends in the orthogonal direction A orthogonal to the contact direction C. Note that the first supporting arm portion 531A may extend in an obliquely intersecting direction obliquely intersecting with the contact direction C (in an obliquely downward direction from the contact portion 51, as viewed in FIG. 3, not shown). The first bent portion 531B is a substantially U-shaped portion which is bent back from the other end of the first supporting arm portion 531A toward an imaginary straight line I (imaginary straight line extending through the contact portion 51, which is parallel to the contact direction C). The first intermediate arm portion 531C has one end integrally connected to the first bent portion 531B, and extends in a manner obliquely intersecting with the imaginary straight line I, when the elastic spring portion 53 is not elastically deformed.

The second spring portion 532 includes a second supporting arm portion 532A, a second bent portion 532B, and a second intermediate arm portion 532C. The second supporting arm portion 532A extends in the orthogonal direction A, and supports the connection portion 52 at a central location thereof. Note that the second supporting arm portion 532A may extend in an obliquely intersecting direction obliquely intersecting with the contact direction C (in an obliquely upward direction from a lower end of a front portion 541, as viewed in FIG. 3, not shown). The second bent portion 532B is a substantially U-shaped portion which is bent back from one end of the second supporting arm portion 532A toward the imaginary straight line I. The second intermediate arm portion 532C has one end integrally connected to the second bent portion 532B. The second intermediate arm portion 532C extends in the orthogonal direction A. Note that the second intermediate arm portion 532C may extend in an obliquely intersecting direction obliquely intersecting with the contact direction C (in an obliquely upward direction from the second bent portion 532B, as viewed in FIG. 3, not shown).

The integral connection portion 533 includes a third bent portion 533A, an integral portion-side arm portion 533B, a fourth bent portion 533C, a fifth bent portion 533D, and a linear arm portion 533E. The third bent portion 533A is an arc-shaped portion which is bent from the other end of the first intermediate arm portion 531C toward a first top board 545A. The integral portion-side arm portion 533B has one end integrally connected to the third bent portion 533A, and extends in an upward direction slightly oblique to the contact direction C. Note that the integral portion-side arm portion 533B may extend in a direction parallel to the contact direction C. The fourth bent portion 533C is an arc-shaped portion which is bent back from the other end of the integral portion-side arm portion 533B toward the second supporting arm portion 532A. The fifth bent portion 533D is an arc-shaped portion which is bent from the other end of the second intermediate arm portion 532C toward the first top board 545A. The linear arm portion 533E integrally connects the fourth bent portion 533C and the fifth bent portion 533D. The linear arm portion 533E extends in the contact direction C.

As shown in FIGS. 1 to 3, the cover portion 54 has a substantially hollow rectangular prism shape, and covers the elastic spring portion 53 and part of the contact portion 51 and part of the connection portion 52.

The cover portion 54 includes the front portion 541, a back portion 542, a left side portion 543, a right side portion 544, a top portion 545, the first cover portion-side contact portion 546, and the second cover portion-side contact portion 547.

The left side portion 543 is continuous with one side portion of the front portion 541, and the right side portion 544 is continuous with the other side portion of the front portion 541. A lower end of the front portion 541 is integrally connected to the other end of the second supporting arm portion 532A. The back portion 542 is formed by a first back board 542A and a second back board 542B. The first back board 542A is continuous with one side portion of the left side portion 543. The second back board 542B is continuous with the right side portion 544. The first back board 542A and the second back board 542B are butted against each other. The top portion 545 is formed by the first top board 545A and a second top board 545B. The first top board 545A and the second top board 545B are continuous with an upper end of the right side portion 544. The first top board 545A and the second top board 545B are separated in the orthogonal direction A, and an opening 548 which communicates with an inner space of the cover portion 54 is formed between the first top board 545A and the second top board 545B. A protruding end of the contact portion 51 protrudes from the top portion 545 through the opening 548. Part of an opening of the cover portion 54 on the lower end side is covered by the second supporting arm portion 532A of the second spring portion 532.

The first cover portion-side contact portion 546 extends in the contact direction C from an end of the first top board 545A closer to the contact portion 51 toward the second spring portion 532.

The second cover portion-side contact portion 547 extends in the contact direction C from an end of the second top board 545B closer to the contact portion 51 toward the second spring portion 532.

A planar shape (not shown) of the elastic spring portion 53, as viewed from above or below in FIG. 4, is substantially rectangular in shape. The longitudinal direction of this rectangular shape is parallel to the orthogonal direction A.

As shown in FIGS. 3 to 5, although the contact portion 51, the first spring portion 531, the second spring portion 532, and the connection portion 52 are arranged on the imaginary straight line I, the integral connection portion 533 is away from the imaginary straight line I in the orthogonal direction A, and is not located on the imaginary straight line I.

The first bent portion 531B, the second bent portion 532B, the fourth bent portion 533C, and the fifth bent portion 533D are away from the imaginary straight line I by an equal distance in the orthogonal direction A ("equal distance" means "nearly equal distance", and does not mean "strictly equal distance", which applies similarly hereinafter).

To electrically connect the first printed circuit board and the second printed circuit board using the connectors 10, first, the connectors 10 are mounted on the second printed circuit board. At this time, the connectors 10 are positioned with respect to the first printed circuit board using a frame made of resin (not shown), and are then fixed.

Next, the first printed circuit board is positioned above the connector 10, and then is moved down. When the contact portions 51 are pressed by the first printed circuit board, the elastic spring portions 53 are compressed, the integral connection portions 533 are moved downward, and the contact portions 51 are retracted into the cover portions 54. At this time, the returning forces of the elastic spring portions 53 bring the contact portions 51 into strong contact with the pads of the first printed circuit board, and the connection portions 52 into strong contact with the pads of the second printed circuit board. As a result, the first printed circuit board and the second printed circuit board are electrically connected by the connectors 10.

According to the present embodiment, since the elastic spring portion 53 includes an integral connection portion 533 which is open loop-shaped (C-shaped in the present embodiment), the spring length of the elastic spring portion 53 is long, and this makes the elastic spring portion 53 soft.

Further, since the integral connection portion 533 is away from the imaginary straight line I in the orthogonal direction A, and is not located between the first spring portion 531 and the second spring portion 532 on the imaginary straight line I, it is possible to reduce the height of the connector 10.

Further, when the contact portion 51 is pressed down by the first printed circuit board, the contact portion 51 is guided in a direction parallel to the contact direction C by the first cover portion-side contact portion 546 and the second cover portion-side contact portion 547. However, since the first bent portion 531B, the second bent portion 532B, the fourth bent portion 533C, and the fifth bent portion 533D are at respective locations away from the imaginary straight line I by the equal distance in the orthogonal direction A, frictional forces generated between the first cover portion-side contact portion 546 and the second cover portion-side contact portion 547, and the contact portion 51 are both small.

Further, since the connector 10 includes the cover portion 54 which covers at least four sides, i.e. front, back, right, and left sides, of the elastic spring portion 53, the connector 10 is easier to handle when using the connector 10 than a connector without the cover portion 54 (not shown).

Further, since the cover portion 54 includes the first cover portion-side contact portion 546 and the second cover portion-side contact portion 547, electric current can be caused to flow also via the cover portion 54, and this makes it possible to increase a cross-sectional area of a passage through which electric current flows (or current passage area). Therefore, it is possible to increase current carrying capacity and reduce inductance, which makes it possible to improve the high-frequency characteristics.

Figure 6:
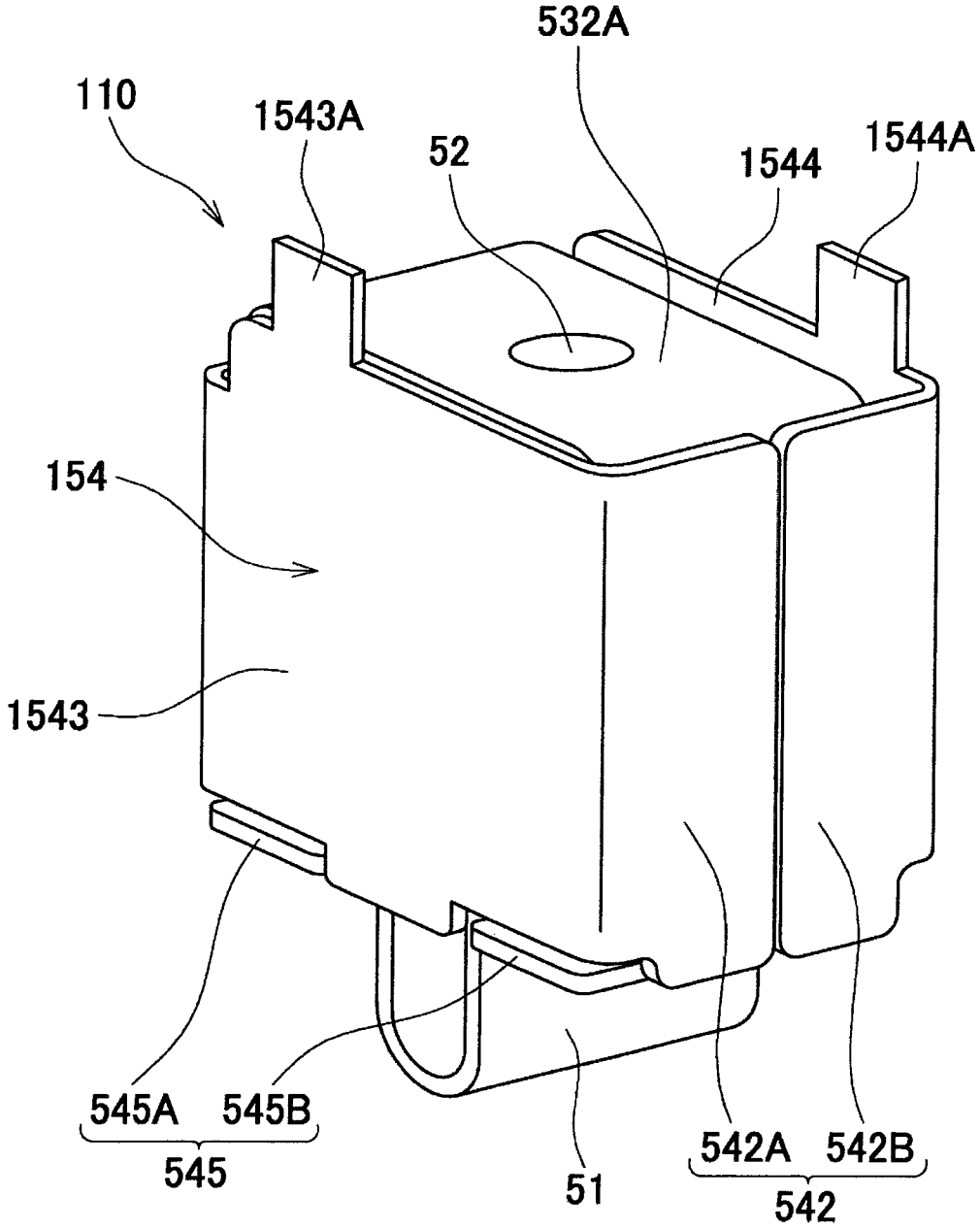
FIG. 6 is a perspective view of a variation of the connector shown in FIG. 1, as viewed obliquely from below.

Next, a description will be given of a first variation of the first embodiment with reference to FIG. 6.

The same components as those of the connector according to the first embodiment are denoted by the same reference numerals, and detailed description thereof is omitted, while only main different components from those of the first embodiment will be described hereinafter.

In the connector 10 of the first embodiment, the cover portion 54 is integrally connected to the second spring portion 532, as described above, and hence the cover portion 54 can be used as a connection portion. In a connector 110 as a variation of the connector 10 of the first embodiment, protruding portions 1543A and 1544A are provided on a left side portion 1543 and a right side portion 1544 of a cover portion 154, respectively, so as to make it possible to positively use the cover portion 154 as a connection section.

The protruding portion 1543A having a rectangular plate-like shape is integrally connected to a lower end of the left side portion 1543, and extends in the contact direction C (along the imaginary straight line I, see FIG. 3).

The protruding portion 1544A having a rectangular plate-like shape is integrally connected to a lower end of the right side portion 1544, and extends in the contact direction C (along the imaginary straight line I, see FIG. 3).

According to the present variation, it is not only possible to obtain the same advantageous effects as provided by the connector 10 of the first embodiment, but also possible to position the connector 10 with respect to the second printed circuit board by inserting the protruding portions 1543A and 1544A into positioning holes (holes associated with the protruding portions 1543A and 1544A) formed in the second printed circuit board, and mount the connector 110 on the second printed circuit board by soldering the protruding portions 1543A and 1544A in through holes (not shown) formed in the second printed circuit board.

Figure 7:
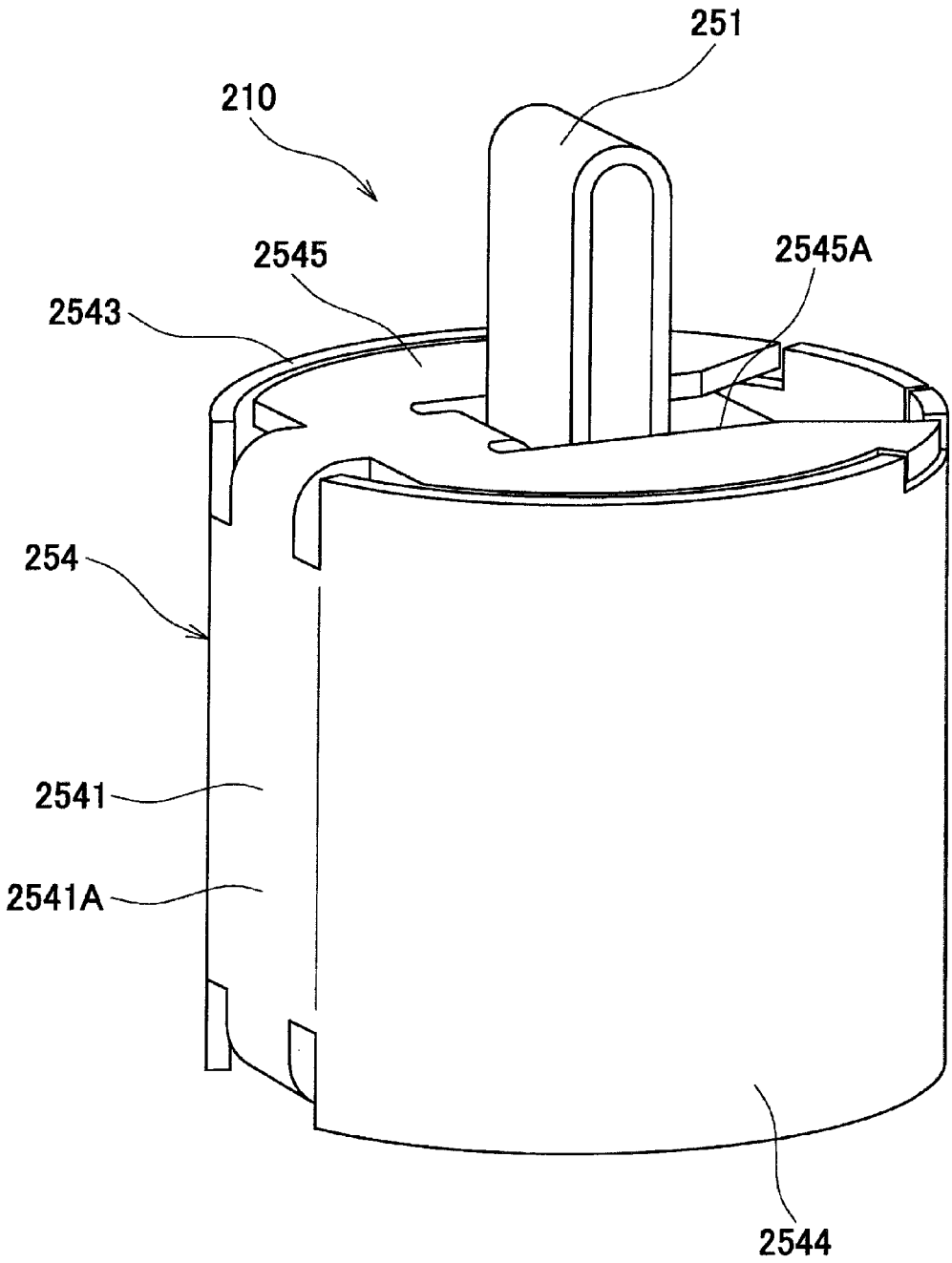
FIG. 7 is a perspective view of a connector according to a second embodiment of the present invention.
Figure 8:
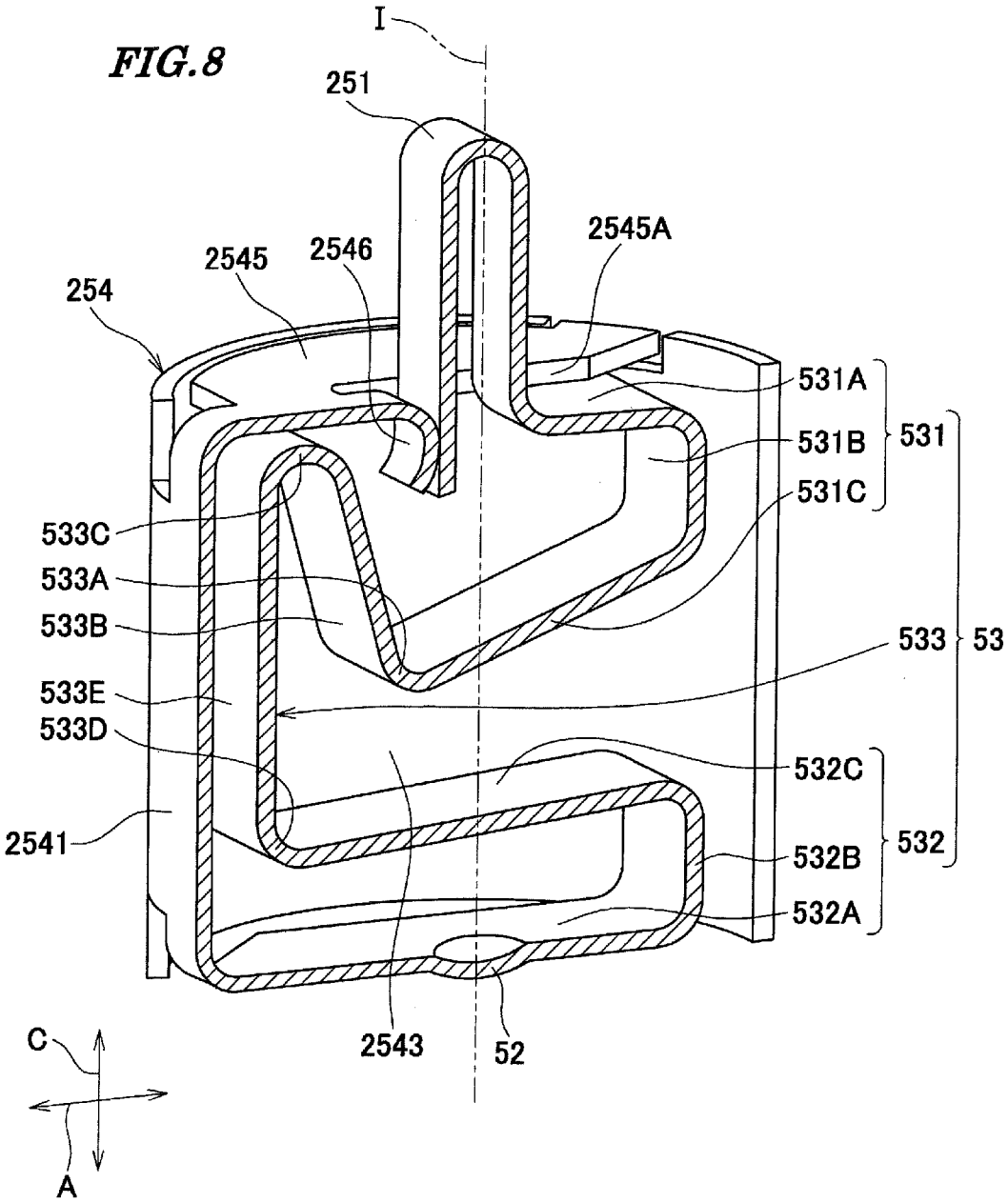
FIG. 8 is a perspective view, partly in cross-section, of the connector shown in FIG. 7.
Figure 9:
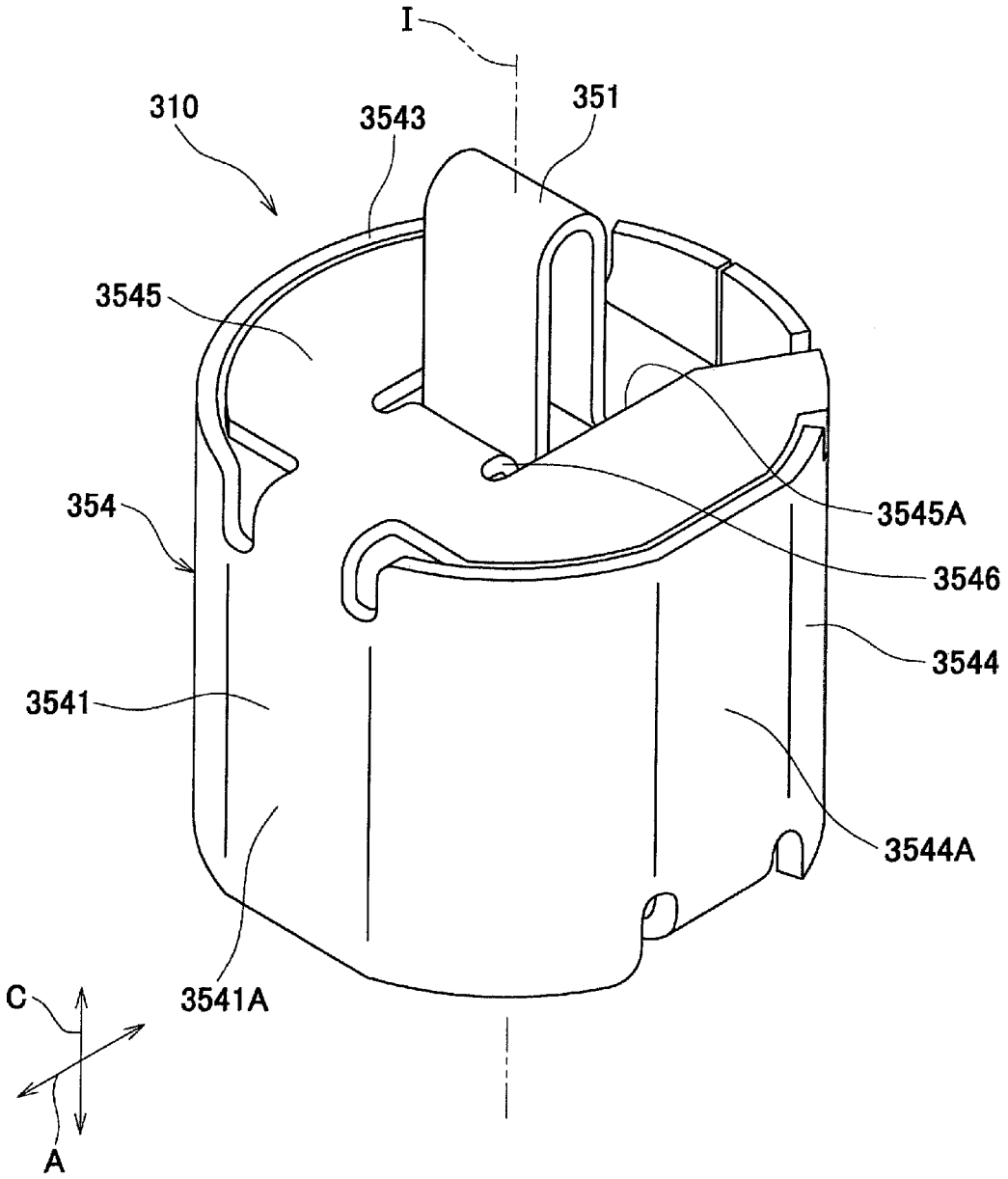
FIG. 9 is a perspective view of a connector according to a third embodiment of the present invention.
Figure 10:
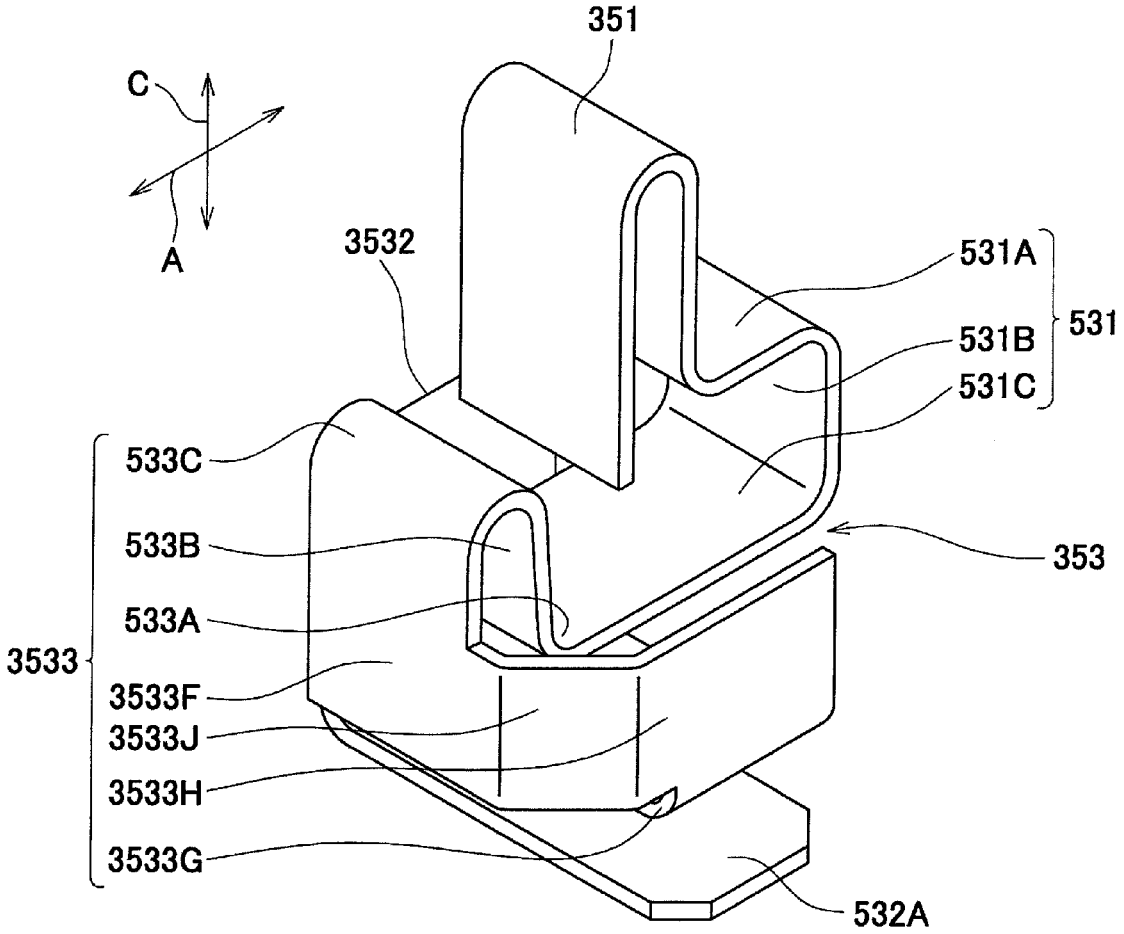
FIG. 10 is a perspective view of part of the connector shown in FIG. 9 from which a cover portion is removed.
Figure 11:
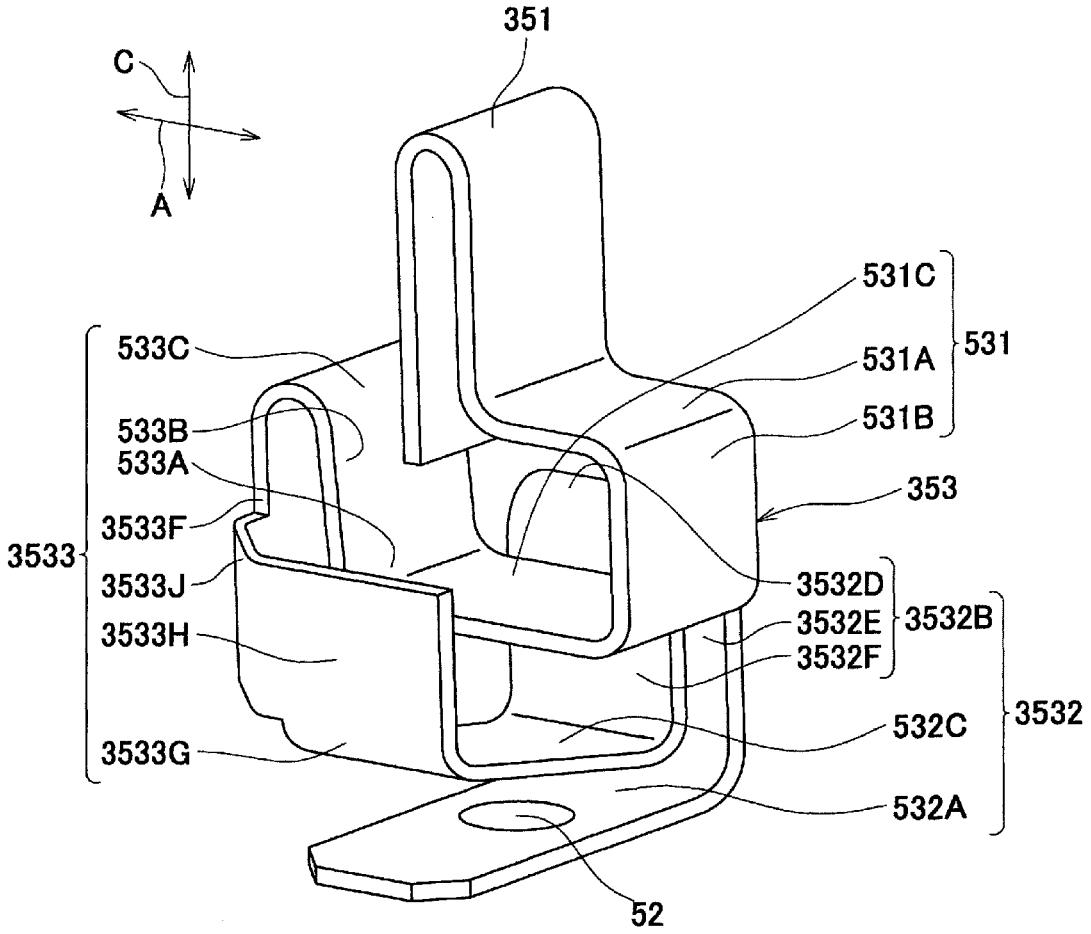
FIG. 11 is a perspective view of the part of the connector shown in FIG. 9 from which the cover portion is removed, as viewed from another angle.
Figure 12:
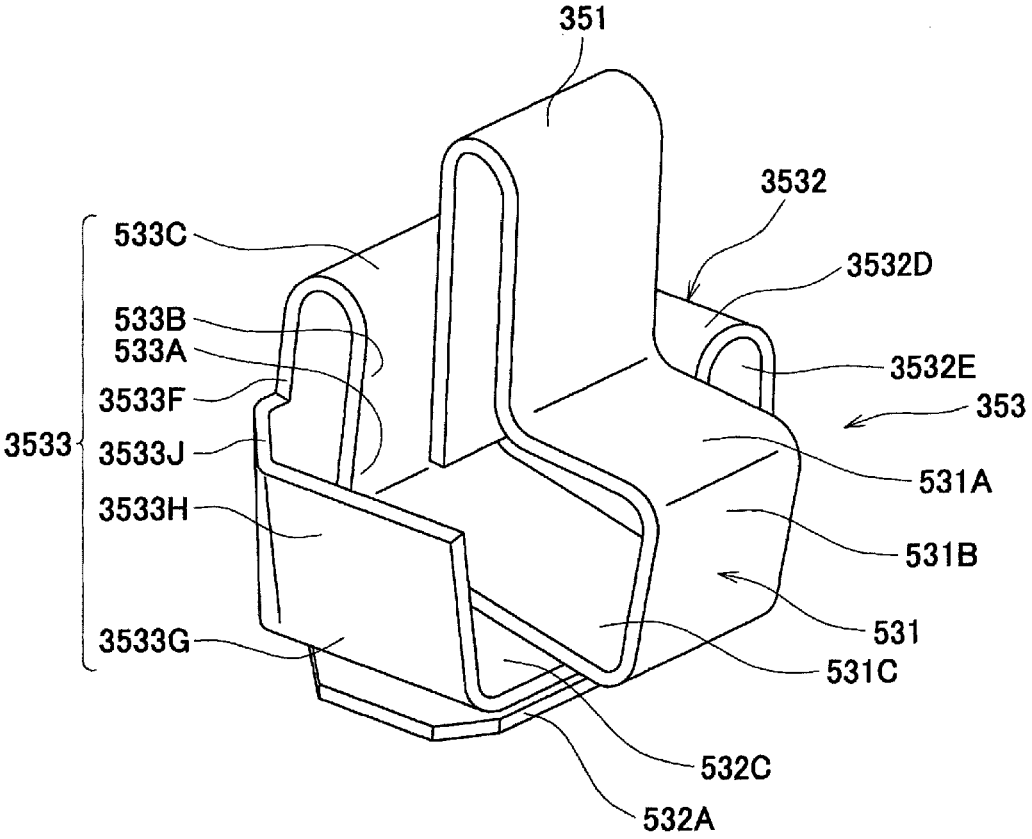
FIG. 12 is a perspective view of the part of the connector shown in FIG. 9 from which the cover portion is removed, in an elastically deformed state.
Figure 13:
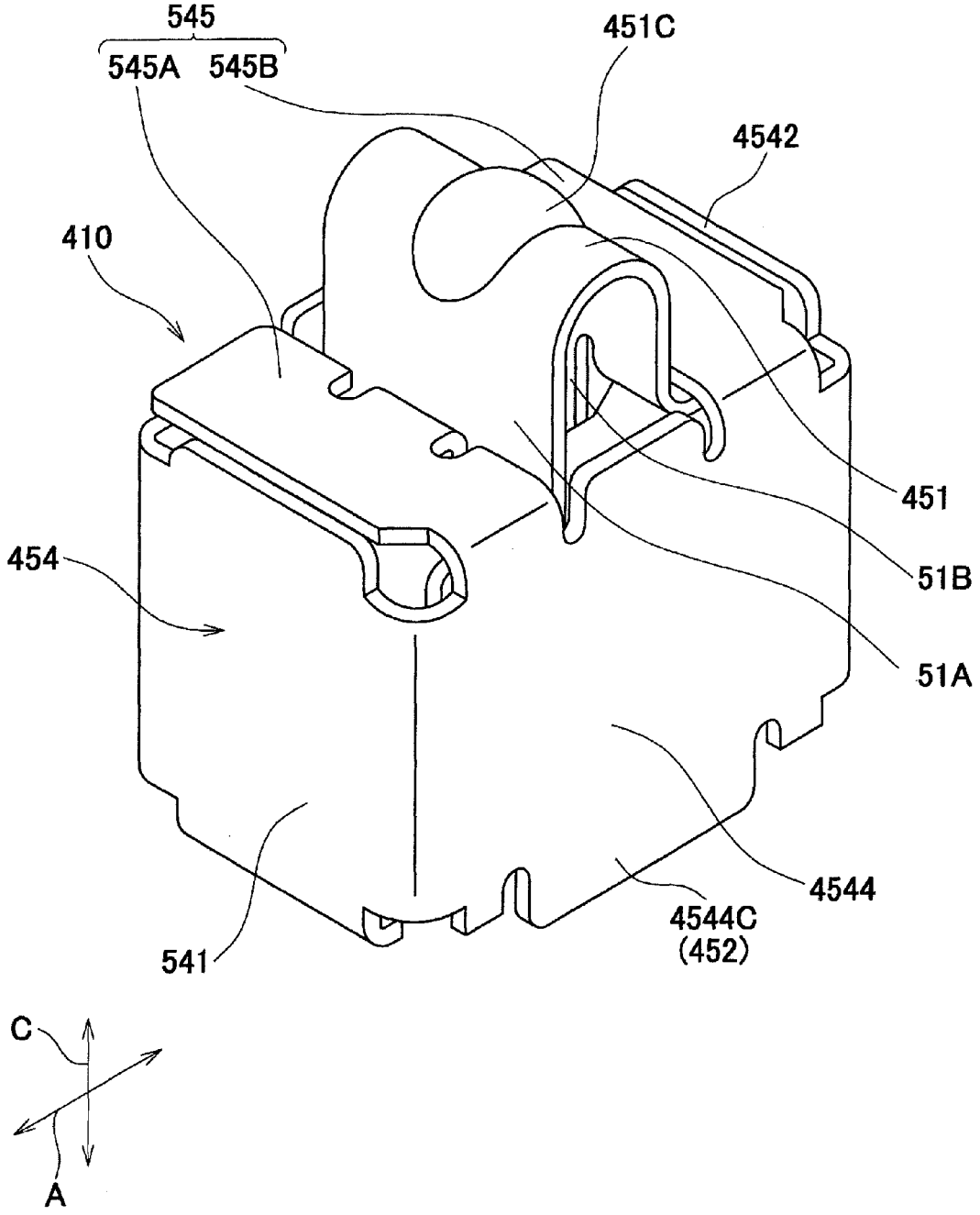
FIG. 13 is a perspective view of a connector according to a fourth embodiment of the present invention.
Figure 14:
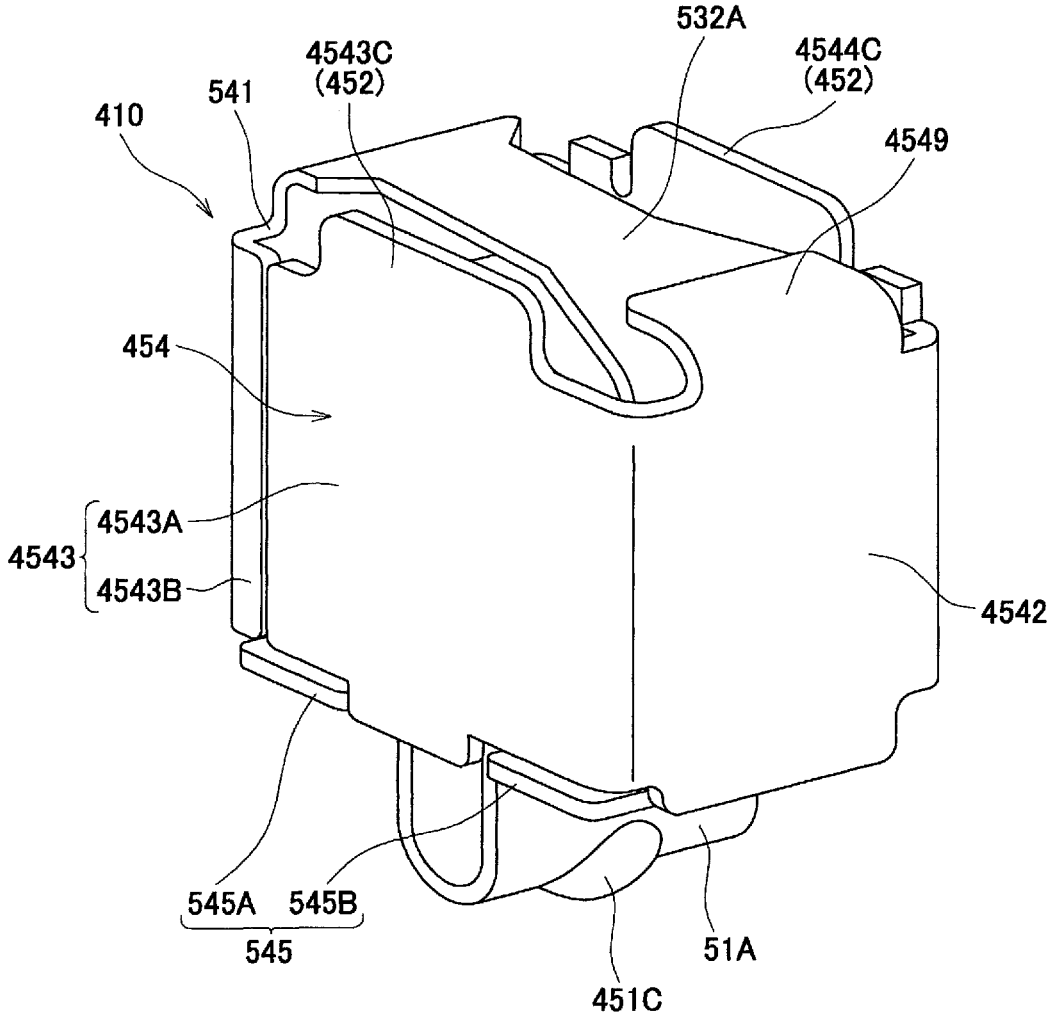
FIG. 14 is a perspective view of the connector shown in FIG. 13, as viewed obliquely from below.
Figure 15:
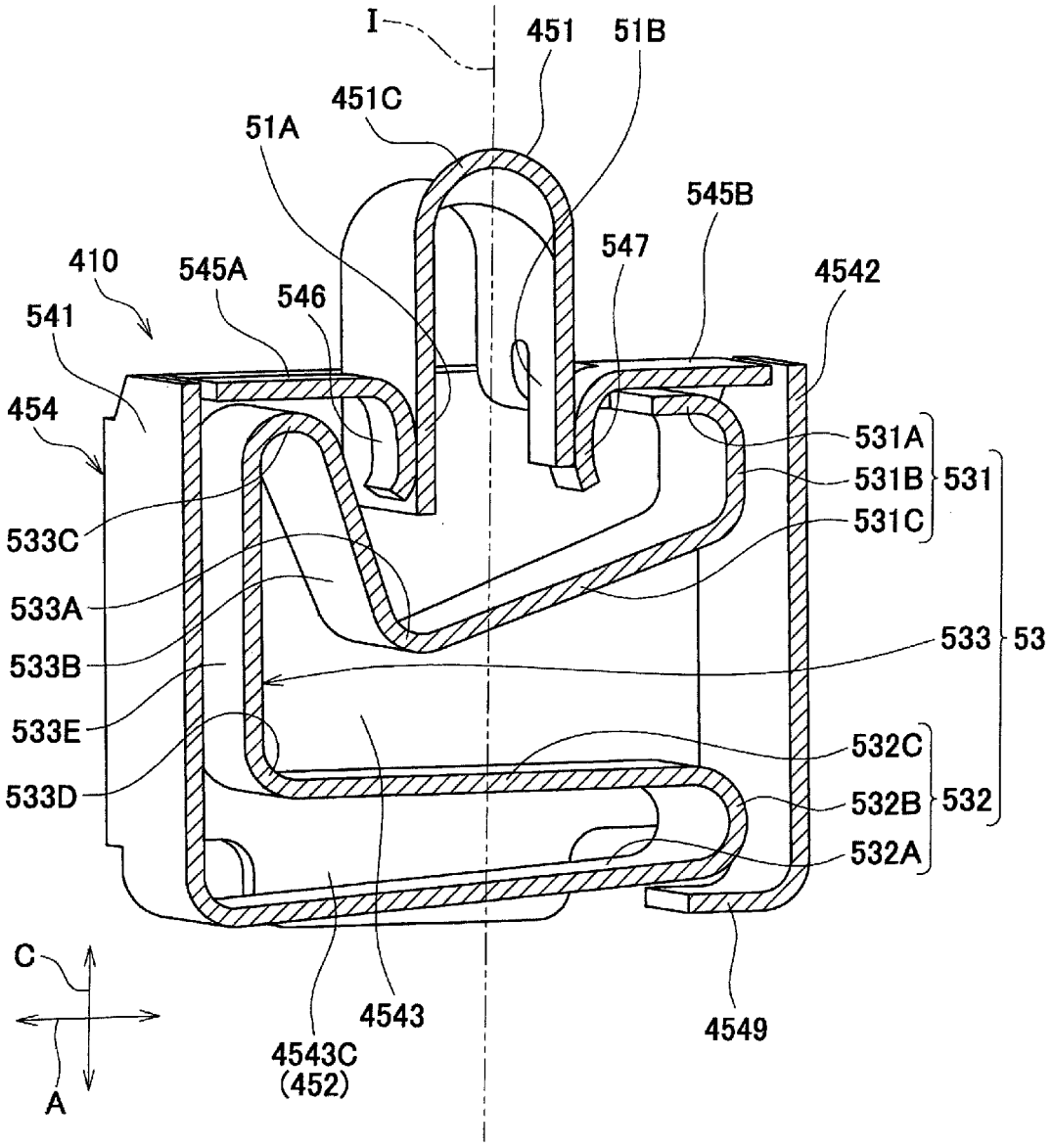
FIG. 15 is a perspective view, partly in cross-section, of the connector shown in FIG. 13.
Figure 16:
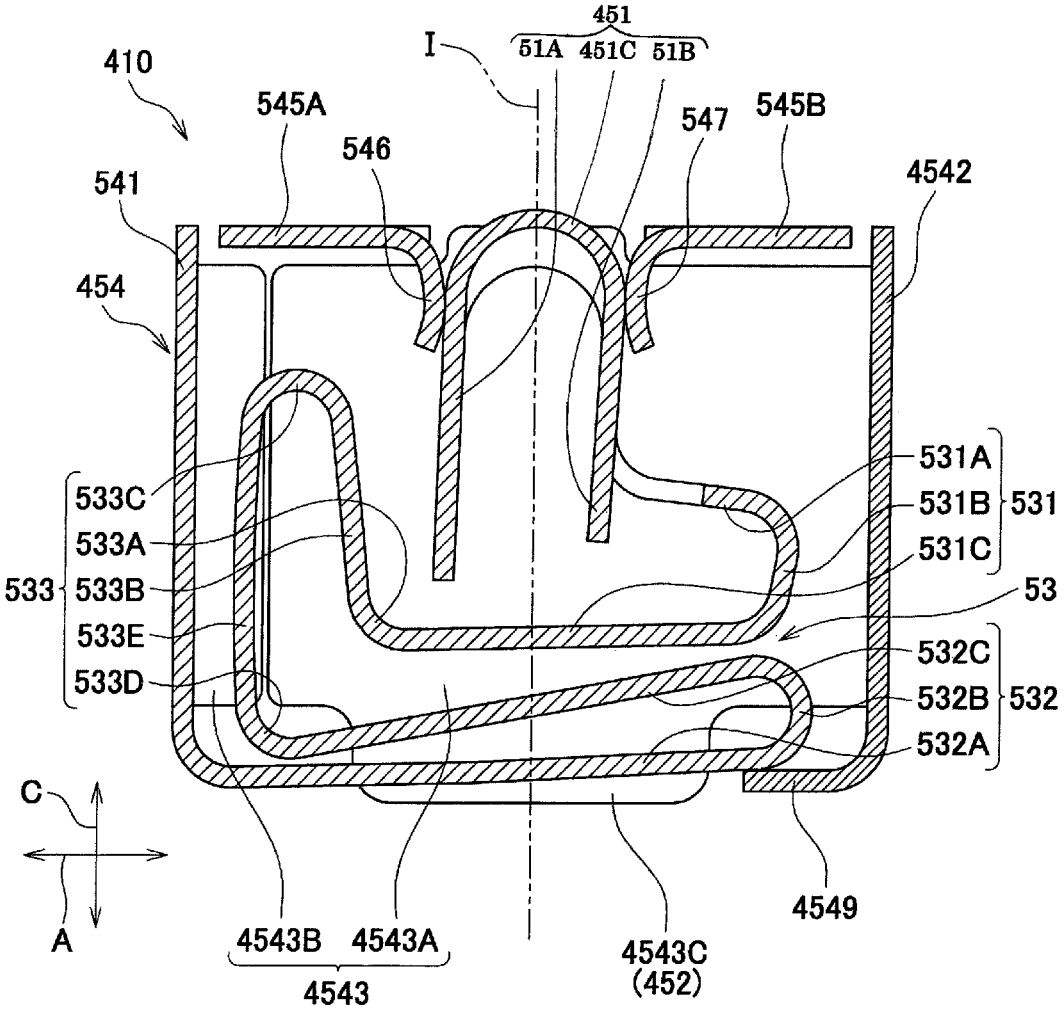
FIG. 16 is a cross-sectional view of the connector shown in FIG. 13, in a state in which a contact portion is retracted into a cover portion.

Next, a description will be given of a second embodiment of the present invention with reference to FIGS. 7 and 8.

The same components as those of the connector according to the first embodiment are denoted by the same reference numerals, and detailed description thereof is omitted, while only main different components from those of the first embodiment will be described hereinafter.

A contact portion 251 of a connector 210 of the second embodiment is formed by bending part of a metal plate into a U-shape.

A cover portion 254 of the connector 210 has a substantially hollow cylindrical shape. The cover portion 254 is formed by a front portion 2541, a left side portion 2543, a right side portion 2544, a top portion 2545, and a cover portion-side contact portion 2546.

The front portion 2541 has a long narrow plate-like shape, and includes a flat surface 2541A. The left side portion 2543 is continuous with one side portion of the front portion 2541, and the right side portion 2544 is continuous with the other side portion of the front portion 2541. The left side portion 2543 has a substantially half hollow cylindrical shape. The right side portion 2544 has a substantially half hollow cylindrical shape. The top portion 2545 is integrally connected to an upper end of the front portion 2541. The top portion 2545 has a cutout 2545A. A protruding end of the contact portion 251 protrudes from the top portion 2545 through the cutout 2545A.

The connector 210 is used in an area where there is no possibility of a force in the direction A, which acts to move the contact portion 251 away from the front portion 2541, being applied to the contact portion 251. For this reason, the connector 210 is not required to sandwich the contact portion 251 between the two cover portion-side contact portions. Therefore, the connector 210 employs only one cover portion-side contact portion 2546.

The cover portion-side contact portion 2546 extends in the contact direction C from the top portion 2545 toward the second spring portion 532.

According to the connector 210 of the second embodiment, it is possible to obtain the same advantageous effects as provided by the connector 10 of the first embodiment.

Note that since the cover portion 254 has the substantially hollow cylindrical shape, when the connector 210 is used in an area where there is no possibility of a force in the direction A being applied to the contact portion 251, it is not necessary to make a plurality of connectors 210 to be mounted on the second printed circuit board, oriented in a uniform direction, which facilitates the operation of mounting the connectors 210. Further, the connector 210 can be used as a connector that is used in a case where the first printed circuit board is disposed vertically to the second printed circuit board. In this case, the flat surface 2541A of the front portion 2541 serves as a soldering portion which is soldered to the second printed circuit board, and is used as the connection portion 52 which can be surface-mounted on the second printed circuit board.

Next, a description will be given of a third embodiment of the present invention with reference to FIGS. 9 to 12.

The same components as those of the connector according to the first embodiment are denoted by the same reference numerals, and detailed description thereof is omitted, while only main different components from those of the first embodiment will be described hereinafter.

A contact portion 351 of a connector 310 of the third embodiment does not include a sub contact portion 51B (see FIG. 4), and has a simple U-shape. Further, the connector 310 differs from the connector 10 of the first embodiment in a second spring portion 3532 and an integral connection portion 3533 of an elastic spring portion 353.

A cover portion 354 of the connector 310 has a substantially hollow cylindrical shape. The cover portion 354 is formed by a front portion 3541, a left side portion 3543, a right side portion 3544, a top portion 3545, and a cover portion-side contact portion 3546.

The front portion 3541 has a long narrow plate-like shape, and includes a flat surface 3541A. The left side portion 3543 is continuous with one side portion of the front portion 3541, and the right side portion 3544 is continuous with the other side portion of the front portion 3541. The left side portion 3543 has a substantially half hollow cylindrical shape. The right side portion 3544 has a substantially half hollow cylindrical shape. The right side portion 3544 includes a flat surface 3544A. The top portion 3545 is integrally connected to an upper end of the front portion 3541. The top portion 3545 has a cutout 3545A. A protruding end of the contact portion 351 protrudes from the top portion 3545 through the cutout 3545A.

Similar to the connector 210, the connector 310 is used in an area where there is no possibility of a force in the direction A being applied to the contact portion 351.

The cover portion-side contact portion 3546 extends in the contact direction C from the top portion 3545 toward the second spring portion 3532.

The elastic spring portion 353 includes the first spring portion 531, the second spring portion 3532, and the integral connection portion 3533.

The second spring portion 3532 includes the second supporting arm portion 532A, a second bent portion 3532B, and the second intermediate arm portion 532C.

The second bent portion 3532B is formed by a bent portion 3532D, a first extended portion 3532E, and a second extended portion 3532F. The bent portion 3532D is arc-shaped. The first extended portion 3532E has one end integrally connected to one end of the bent portion 3532D, and the other end integrally connected to the one end of the second supporting arm portion 532A. The second extended portion 3532F has one end integrally connected to the other end of the bent portion 3532D, and the other end integrally connected to the one end of the second intermediate arm portion 532C.

The integral connection portion 3533 includes the third bent portion 533A, the integral portion-side arm portion 533B, the fourth bent portion 533C, a first linear arm portion 3533F, a fifth bent portion 3533G, a second linear arm portion 3533H, and a direction changing portion 3533J.

The first linear arm portion 3533F, which has a plate-like shape, is integrally connected to the fourth bent portion 533C, and extends in the contact direction C. The fifth bent portion 3533G is integrally connected to the other end of the second intermediate arm portion 532C. The second linear arm portion 3533H, which has a plate-like shape, is integrally connected to the fifth bent portion 3533G, and extends in the contact direction C. The direction changing portion 3533J connects the second linear arm portion 3533H to the first linear arm portion 3533F such that a direction of the thickness of the second linear arm portion 3533H is at right angles to a direction of the thickness of the first linear arm portion 3533F.

A planar shape (not shown) of the first spring portion 531, as viewed from above or below along the imaginary straight line I, is substantially rectangular. A planar shape (not shown) of the second spring portion 3532, as viewed from above or below along the imaginary straight line I, is substantially rectangular. A longitudinal direction of the planar shape of the first spring portion 531 and a longitudinal direction of the planar shape of the second spring portion 3532 are orthogonal to each other. Therefore, a space within the cover portion 354 can be effectively used as a space for accommodating the first spring portion 531 and the second spring portion 3532.

According to the connector 310 of the third embodiment, it is not only possible to obtain the same advantageous effects as provided by the connectors 10 and 210 of the above-described embodiments, but also possible to use the flat surfaces 3541A and 3544A as soldering portions when the connector 310 is mounted on the second printed circuit board. That is, the connector 310 can be used as a connector that is used in a case where the first printed circuit board is disposed vertically to the second printed circuit board. In this case, the flat surfaces 3541A and 3544A of the cover portion 354 serve as soldering portions which are soldered to the second printed circuit board, and are used as the connection portion 52 which can be surface-mounted on the second printed circuit board.

Further, by employing the direction changing portion 3533J, the longitudinal direction of the planar shape of the first spring portion 531 and the longitudinal direction of the planar shape of the second spring portion 3532 are made orthogonal to each other, as described above, whereby it is made possible to make use of the space within the cover portion 354 without waste, and hence it is possible to increase the spring length of the elastic spring portion 353 without increasing the size of the cover portion 354.

Next, a description will be given of a fourth embodiment of the present invention with reference to FIGS. 13 to 18.

The same components as those of the connector according to the first embodiment are denoted by the same reference numerals, and detailed description thereof is omitted, while only main different components from those of the first embodiment will be described hereinafter.

As shown in FIGS. 13 to 16, a contact portion 451 is formed by bending part of a metal plate into a U-shape. The contact portion 451 includes a hemispherical convex portion 451C.

Connection portions 452 are plate-shaped, and are formed as part of a cover portion 454, respectively.

The cover portion 454 is formed by the front portion 541, a back portion 4542, a left side portion 4543, a right side portion 4544, and a stopper 4549.

The back portion 4542 is plate-shaped. The left side portion 4543 is formed by a first left side board 4543A and a second left side board 4543B. The first left side board 4543A is continuous with one side portion of the back portion 4542. The first left side board 4543A is formed with a soldering portion 4543C (connection portion 452) on a lower end portion thereof. The second left side board 4543B is continuous with the one side portion of the front portion 541. The second left side board 4543B is butted against the first left side board 4543A.

The right side portion 4544 is plate-shaped, and one side portion of the right side portion 4544 is integrally connected to the other side portion of the front portion 541. The other side portion of the right side portion 4544 is integrally connected to the other side portion of the back portion 4542. The right side portion 4544 is formed with a soldering portion 4544C (connection portion 452) on a lower end portion thereof.

The stopper 4549 is integrally connected to the lower end of the back portion 4542, and is bent toward the front portion 541.

When the contact portion 451 is pressed by the first printed circuit board, causing elastic deformation of the elastic spring portion 53, the stopper 4549 supports the second supporting arm portion 532A. This prevents the second spring portion 532 from protruding from the cover portion 454. As a result, when the contact portion 451 is pressed by the first printed circuit board, the elastic spring portion 53 is positively compressed, whereby the spring force is positively generated in the elastic spring portion 53.

Next, a description will be given of an example of a method of manufacturing the connector, denoted by reference numeral 410.

Figure 17:
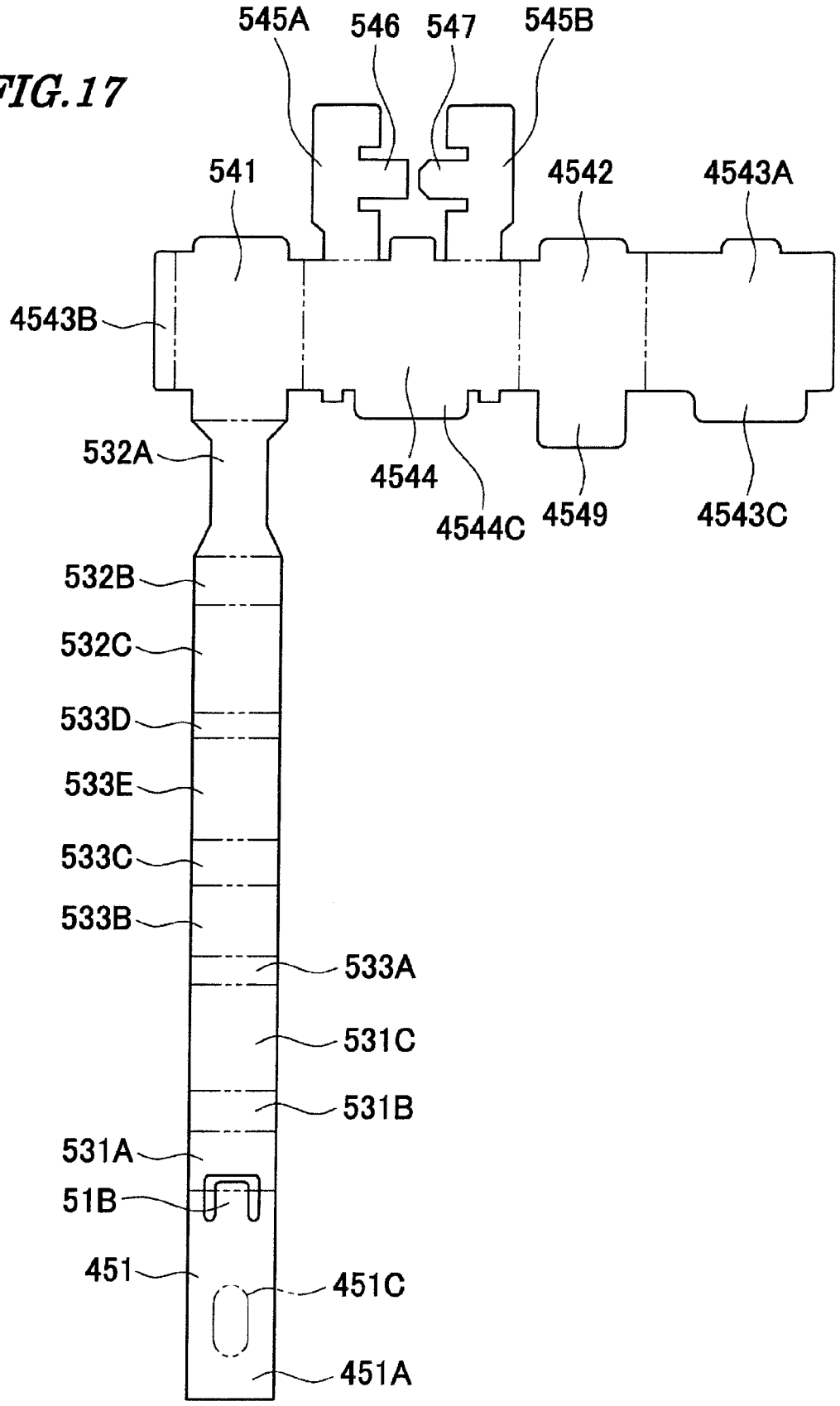
FIG. 17 is a development view of the connector shown in FIG. 13.

First, a metal plate (not shown) is blanked into a developed shape shown in FIG. 17 by a press apparatus (not shown).

Next, the protruding portion 451C is formed by beating the blanked metal plate. A boundary portion between the contact portion 451 and the first supporting arm portion 531A, the first bent portion 531B, the third bent portion 533A, the fourth bent portion 533C, the fifth bent portion 533D, the second bent portion 532B, and a boundary portion between the second supporting arm portion 532A and the front portion 541 are bent by the press apparatus, respectively, to thereby form the contact portion 451 and the elastic spring portion 53.

Then, a boundary portion between the second left side board 4543B and the front portion 541, a boundary portion between the front portion 541 and the right side portion 4544, a boundary portion between the right side portion 4544 and the back portion 4542, and a boundary portion between the back portion 4542 and the first left side board 4543A are bent by the press apparatus, respectively, to thereby form the cover portion 454, and the elastic spring portion 53 is received in the cover portion 454.

Next, the first cover portion-side contact portion 546 and the second cover portion-side contact portion 547 are bent by the press apparatus.

Finally, a boundary portion between the first top board 545A and the right side portion 4544, and a boundary portion between the second top board 545B and the right side portion 4544 are bent by the press apparatus, respectively, to thereby form the first top board 545A and the second top board 545B.

By executing the above processes, the connector 410 is manufactured.

Figure 18:
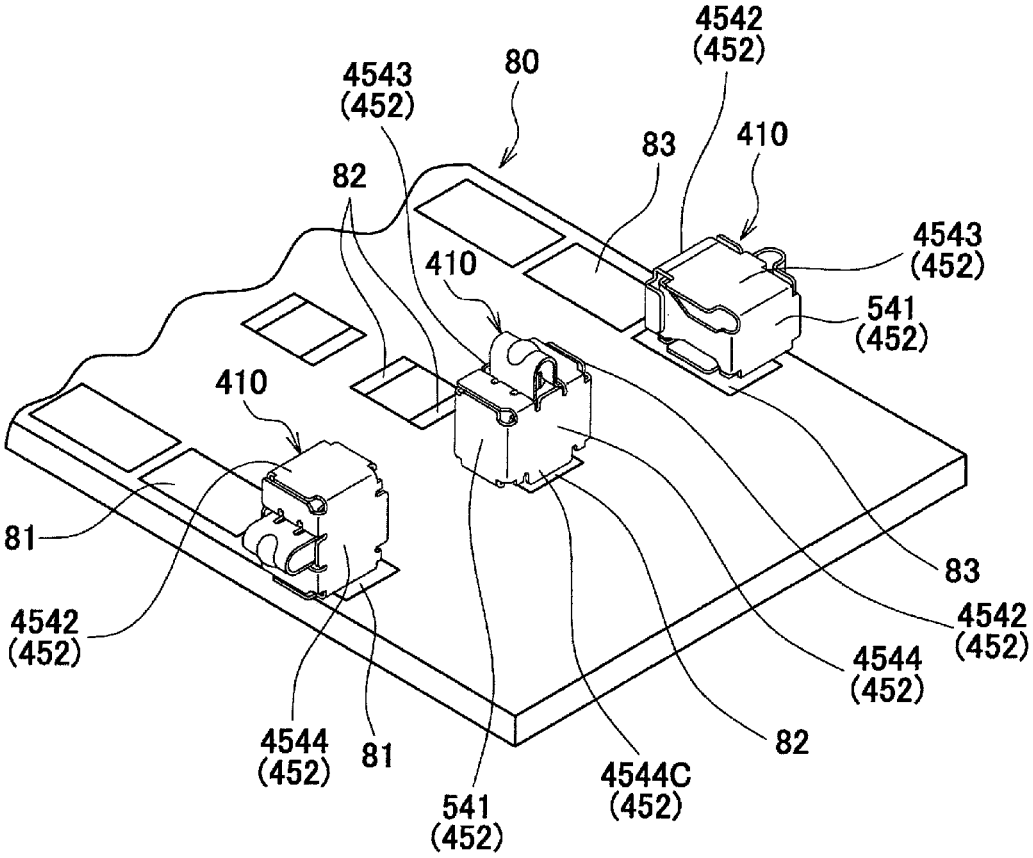
FIG. 18 is a perspective view of part of a second printed circuit board in a state having the connectors each shown in FIG. 13 mounted thereon.
Figure 19:
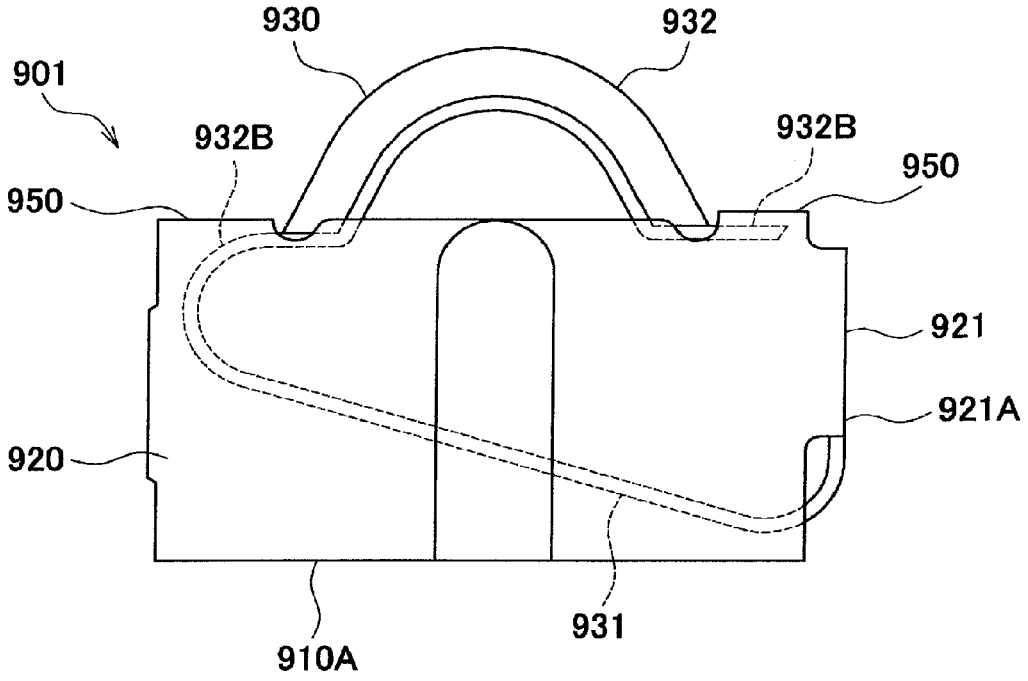
FIG. 19 Prior Art
FIG. 19 is a side view of a conventional conductive member.
Figure 20:
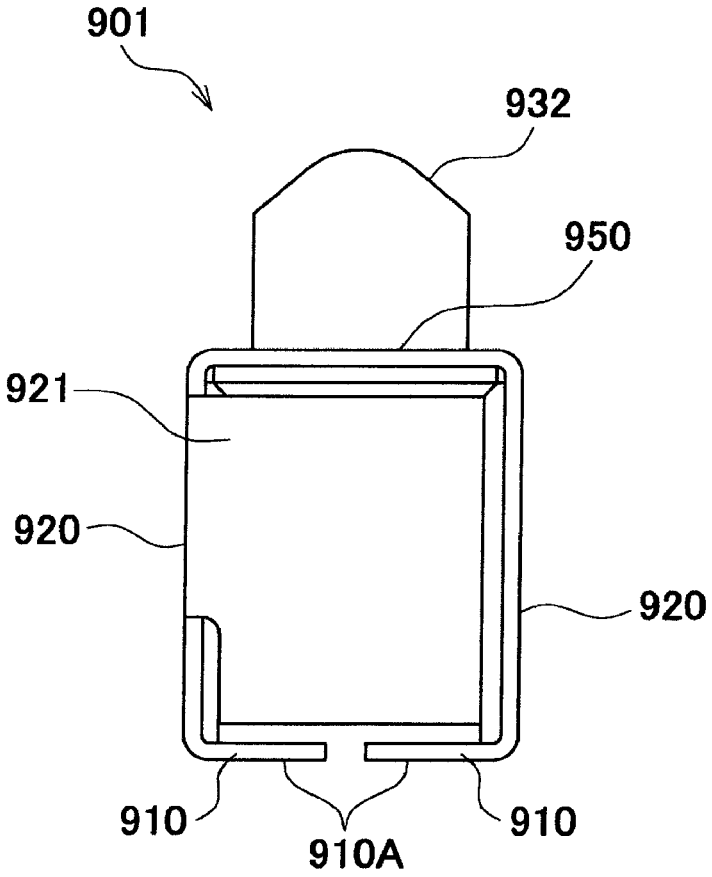
FIG.20 Prior Art
FIG. 20 is a front view of the conductive member shown in FIG. 19.
Figure 21:
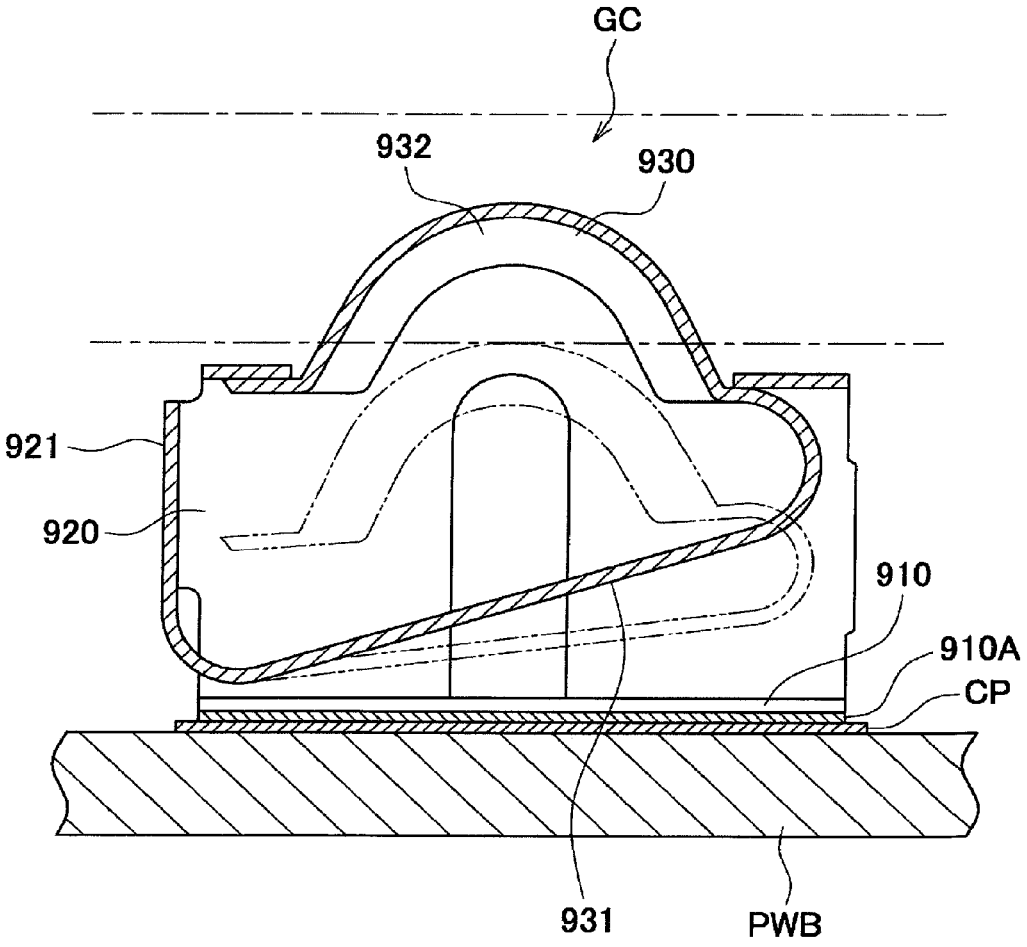
FIG.21 Prior Art
FIG. 21 is a longitudinal cross-sectional view of the conductive member shown in FIG. 19.

As shown in FIG. 18, the mounting of the connector 410 on the second printed circuit board, denoted by reference numeral 80, by soldering, can be performed in three manners.

In a first manner of mounting, the front portion 541 or the back portion 4542 of the cover portion 454 is soldered to a pad 81 of the second printed circuit board 80.

In a second manner of mounting, the soldering portions 4544C and 4543C of the cover portion 454 are soldered to a pair of pads 82 of the second printed circuit board 80, respectively.

In a third manner of mounting, the left side portion 4543 or the right side portion 4544 of the cover portion 454 is soldered to a pad 83 of the second printed circuit board 80.

According to the present embodiment, it is possible to obtain the same advantageous effects as provided by the connector 10 of the first embodiment. Further, it is unnecessary to support the second spring portion 532 by the second printed circuit board 80 since the cover portion 454 includes the stopper 4549, and it is possible to mount the connector 410 on the second printed circuit board 80 by soldering any of the front portion 541, the back portion 4542, the left side portion 4543, and the right side portion 4544 of the cover portion 454, to thereby use any of these portions as the connection portion 452. Further, since the left side portion 4543 and the right side portion 4544 are formed with the soldering portions 4543C and 4544C, respectively, it is also possible to mount the connector 410 on the second printed circuit board 80 using one of the soldering portions 4543C and 4544C. That is, it is possible to use any of five of the six surfaces of the cover portion 454 which is hollow rectangular prism-shaped, except the surface having the contact portion, as the connection portion 452.

Note that although the connectors 10, 110, 210, 310, and 410 of the above-described embodiments include the cover portions 54, 154, 254, 354, and 454, respectively, it is not necessarily required to employ the cover portions 54, 154, 254, 354, and 454.

Further, although in the above-described embodiments and variation, the cover portions 54, 154, 254, 354, and 454 are integrally connected to the second spring portion 532 or 3532, the cover portions 54, 154, 254, 354, and 454 may be integrally connected to the first spring portion 531, or the connection portion 52 or 452.

It is further understood by those skilled in the art that the foregoing are the preferred embodiments of the present invention, and that various changes and modification may be made thereto without departing from the spirit and scope thereof.

What is claimed is:

1. A connector that electrically connects a first object to be connected and a second object to be connected, the connector comprising:

a contact portion that can be brought into contact with the first object to be connected;

a connection portion that is connectable to the second object to be connected; and an elastic spring portion that integrally connects the contact portion and the connection portion, wherein the elastic spring portion includes an integral connection portion that is open loop-shaped, and a first spring portion and a second spring portion that are integrally connected via the integral connection portion, wherein when the contact portion is pressed by the first object to be connected, and the elastic spring portion elastically deforms, the integral connection portion moves in the same direction as a contact portion-moving direction in which the contact portion moves, wherein the first spring portion and the second spring portion are arranged on an imaginary straight line which extends through the contact portion and is parallel to the contact portion-moving direction, wherein the integral connection portion is shifted from the imaginary straight line in an orthogonal direction orthogonal to the contact portion-moving direction, wherein the connector further comprises a cover portion that is provided integrally with at least one of the first spring portion, the second spring portion, and the connection portion, and that covers the first spring portion, the second spring portion, and the integral connection portion, wherein the cover portion includes a cover portion-side contact portion that is brought into contact with the contact portion, wherein the cover portion-side contact portion extends along the contact portion-moving direction from an upper surface portion of the cover portion, and wherein the cover portion-side contact portion is in constant contact with the contact portion.

2. The connector according to claim 1, wherein the cover portion has a hollow rectangular prism shape.

3. The connector according to claim 1, wherein the cover portion has a hollow cylindrical shape.

4. The connector according to claim 1, wherein the cover portion-side contact portion includes two cover portion-side contact portions.

5. The connector according to claim 1, wherein the cover portion includes a stopper, and wherein when the contact portion is pressed by the first object to be connected, and the elastic spring portion is elastically deformed, the stopper receives the second spring portion so as to prevent the second spring portion from protruding out of the cover portion.

6. The connector according to claim 1, wherein the cover portion includes a flat surface that can be surface-mounted on the second object to be connected.

7. The connector according to claim 1, wherein the cover portion includes a protruding portion extending along the imaginary straight line.

8. The connector according to claim 1, wherein the connector is electrically connected to the second object to be connected by having the connection portion brought into contact with the second object.

9. The connector according to claim 1, wherein the connector is electrically connected to the second object to be connected by having the connection portion soldered to the second object.

10. A connector that electrically connects a first object to be connected and a second object to be connected, the connector comprising:

a contact portion that can be brought into contact with the first object to be connected;

a connection portion that is connectable to the second object to be connected; and an elastic spring portion that integrally connects with the contact portion and the connection portion, wherein the elastic spring portion includes an integral connection portion that is open loop-shaped, and a first spring portion and a second spring portion that are integrally connected via the integral connection portion, wherein when the contact portion is pressed by the first object to be connected, and the elastic spring portion elastically deforms, the integral connection portion moves in the same direction as a contact portion-moving direction in which the contact portion moves wherein the first spring portion includes:

a first supporting arm portion that supports the contact portion, and extends in an intersecting direction intersecting with the contact portion-moving direction;

a first bent portion that is arc-shaped and is integrally connected to the first supporting arm portion;

a first intermediate arm portion that is integrally connected to the first bent portion and extends in a direction opposite to the first supporting arm portion, wherein the second spring portion includes:

a second supporting arm portion that supports the connection portion and extends in the intersecting direction;

a second bent portion that is arc-shaped and is integrally connected to one end of the second supporting arm portion; and a second intermediate arm portion that is integrally connected to the second bent portion and extends in a direction opposite to the second supporting arm portion, and wherein the integral connection portion includes:

a third bent portion that is arc-shaped and is integrally connected to the first intermediate arm portion;

an integral portion-side arm portion that is integrally connected to the third bent portion and extends in the contact portion-moving direction;

a fourth bent portion that is arc-shaped and is integrally connected to the integral portion-side arm portion;

a fifth bent portion that is arc-shaped and is integrally connected to the second intermediate arm portion; and a linear arm portion that integrally connects the fourth bent portion and the fifth bent portion.

11. The connector according to claim 10, wherein the first spring portion and the second spring portion are arranged on an imaginary straight line which extends through the contact portion and is parallel to the contact portion-moving direction, and wherein the integral connection portion is shifted from the imaginary straight line in an orthogonal direction orthogonal to the contact portion-moving direction.

12. A connector that electrically connects a first object to be connected and a second object to be connected, the connector comprising:

a contact portion that can be brought into contact with the first object to be connected;

a connection portion that is connectable to the second object to be connected; and an elastic spring portion that integrally connects the contact portion and the connection portion, wherein the elastic spring portion includes an integral connection portion that is open loop-shaped, and a first spring portion and a second spring portion that are integrally connected via the integral connection portion, wherein when the contact portion is pressed by the first object to be connected, and the elastic spring portion elastically deforms, the integral connection portion moves in the same direction as a contact portion-moving direction in which the contact portion moves, and wherein the contact portion has a shape bent into a U-shape, and a protruding end of the contact portion is a bottom of the U-shape.

13. A connector that electrically connects a first object to be connected and a second object to be connected, the connector comprising:

a contact portion that can be brought into contact with the first object to be connected;

a connection portion that is connectable to the second object to be connected; and an elastic spring portion that integrally connects the contact portion and the connection portion, wherein the elastic spring portion includes an integral connection portion that is open loop-shaped, and a first spring portion and a second spring portion that are integrally connected via the integral connection portion, wherein when the contact portion is pressed by the first object to be connected, and the elastic spring portion elastically deforms, the integral connection portion moves in the same direction as a contact portion-moving direction in which the contact portion moves, wherein the first spring portion and the second spring portion are arranged on an imaginary straight line which extends through the contact portion and is parallel to the contact portion-moving direction, wherein the integral connection portion is shifted from the imaginary straight line in an orthogonal direction orthogonal to the contact portion-moving direction, and wherein the contact portion has a shape bent into a U-shape, and a protruding end of the contact portion is a bottom of the U-shape.

* * * * *